US007384130B2

(12) United States Patent
Kubota et al.

(10) Patent No.: US 7,384,130 B2
(45) Date of Patent: Jun. 10, 2008

(54) LIQUID EJECTION HEAD

(75) Inventors: Masahiko Kubota, Tokyo (JP); Masashi Miyagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 11/347,604

(22) Filed: Feb. 6, 2006

(65) Prior Publication Data

US 2006/0125877 A1 Jun. 15, 2006

Related U.S. Application Data

(62) Division of application No. 10/191,576, filed on Jul. 10, 2002, now Pat. No. 7,036,909.

(30) Foreign Application Priority Data

Jul. 11, 2001 (JP) ..... 2001-211021

(51) Int. Cl.
*B41J 2/14* (2006.01)
*B41J 2/16* (2006.01)

(52) U.S. Cl. ..... 347/47; 347/44

(58) Field of Classification Search ..... 347/20, 347/44, 47, 54, 56, 61–65, 67, 92–94
See application file for complete search history.

(56) References Cited

U.S. PATENT DOCUMENTS 4,209,794 A * 6/1980 Kattner ..... 347/47
4,490,728 A 12/1984 Vaught et al. ..... 347/60
4,882,595 A 11/1989 Trueba et al. ..... 347/85
5,900,894 A 5/1999 Koizumi et al. ..... 347/65
6,003,977 A 12/1999 Weber et al. ..... 347/63
6,062,678 A 5/2000 Ishinaga et al. ..... 347/62
6,142,607 A 11/2000 Takata et al. ..... 347/47
6,158,843 A 12/2000 Murthy et al. ..... 347/47
6,290,335 B1 9/2001 Kawai et al. ..... 347/62
6,435,661 B1 8/2002 Inoue et al. ..... 347/48
6,435,670 B1 8/2002 Inoue et al. ..... 347/65
6,447,984 B1 9/2002 Tatsumi et al. ..... 430/320

(Continued)

FOREIGN PATENT DOCUMENTS

EP 0 308 272 3/1989

(Continued)

OTHER PUBLICATIONS

Office Action issued in corresponding European Application No. 02 015 367.2 on Aug. 6, 2007.

*Primary Examiner*—Juanita D Stephens
(74) *Attorney, Agent, or Firm*—Fitzpatrick, Cella, Harper & Scinto

(57) ABSTRACT

A liquid ejection head has an element substrate on which a plurality of heaters for generating energy for ejecting liquid droplets are disposed, a nozzle forming member laminated on the main surface of the element substrate and including a plurality of nozzles each having an ejection port for ejecting liquid droplets, a bubble forming chamber in which bubbles are formed by a heater, and a supply path for supplying liquid from a supply chamber to the bubble forming chamber. The nozzle forming member has a portion located in the vicinity of the heaters on the supply path side where the height of the nozzles is reduced, whereby the height of the nozzles changes toward the supply chamber.

12 Claims, 18 Drawing Sheets

6

6

U.S. PATENT DOCUMENTS

| | | | | |
|---|---|---|---|---|
| 6,454,379 | B1 | 9/2002 | Taneya et al. | 347/19 |
| 6,464,345 | B2 | 10/2002 | Kubota et al. | 347/65 |
| 6,497,475 | B1 | 12/2002 | Kubota et al. | 347/65 |
| 6,511,162 | B1 | 1/2003 | Kashino et al. | 347/71 |
| 6,527,377 | B1 | 3/2003 | Ikegame et al. | 347/56 |
| 6,533,400 | B1 | 3/2003 | Kudo et al. | 347/63 |
| 6,569,343 | B1 | 5/2003 | Suzuki et al. | 216/27 |
| 6,745,467 | B1 | 6/2004 | Terai et al. | 29/890.1 |

FOREIGN PATENT DOCUMENTS

| | | |
|---|---|---|
| EP | 0 465 071 | 1/1992 |
| EP | 0 719 647 | 7/1996 |
| EP | 0 835 759 | 4/1998 |
| EP | 1 060 892 | 12/2000 |
| JP | 54-161935 | 12/1979 |
| JP | 61-185455 | 8/1986 |
| JP | 61-249768 | 11/1986 |
| JP | 4-10940 | 1/1992 |
| JP | 4-10941 | 1/1992 |
| JP | 5-84909 | 4/1993 |
| JP | 10-81011 | 3/1998 |
| JP | 2000-255072 | 9/2000 |

* cited by examiner 20
22
21
11

42
41
11

26
41
42
11
12

26
41
42
36
11
12

26
36
11
12

LIQUID EJECTION HEAD

This is a divisional application of application Ser. No. 10/191,576, filed on Jul. 10, 2002 now U.S. Pat. No. 7,036,909, now allowed.

BACKGROUND OF THE INVENTION

1. Field of the Invention

The present invention relates to a liquid ejection head for executing recording on a recording medium by ejecting liquid droplets such as, for example, ink droplets, and more particularly, to a liquid ejection head for executing inkjet recording.

2. Description of the Related Art

An inkjet recording system is one of so-called non-impact recording systems.

This inkjet recording system produces a negligible degree of small noise in recording and can execute recording at a high speed.

Further, the inkjet recording system can execute recording on various types of recording mediums, that is, it can fix ink on so-called plain paper without the need of special processing, and further can obtain a very fine image at a low cost. Recently, the inkjet recording system has become widely used rapidly as a recording means for a copier, facsimile, word processor, and the like due to these advantages, in addition to being used as a printer acting as a peripheral unit of a computer.

As an ink ejection method ordinarily used in the inkjet recording system, there are available a method of using an electrothermal transducer, for example, a heater, and a method of using a piezoelectric transducer, for example, a piezoelectric element, as an ejection energy generating element used to eject ink droplets. In any of the methods, the ejection of ink droplets can be controlled by an electric signal. A principle of the ink ejection method using the electrothermal transducer is that ink in the vicinity of the electrothermal transducer is instantly boiled by a voltage applied to the electrothermal transducer, and ink droplets are ejected at a high speed by the rapid growth of bubbles caused by the change of phase of ink in the boiling. In contrast, a principle of the ink ejection method using the piezoelectric transducer is that the piezoelectric transducer is displaced by a voltage applied thereto, and ink droplets are ejected by a pressure generated when the piezoelectric transducer is displaced.

The ink ejection method using the electrothermal transducer is advantageous in that a large space is not necessary to dispose an ejection energy generating element, the structure of the recording head is simple, and nozzles can be easily integrated. In contrast, a defect inherent to this ink ejection method resides in that the volume of a flying ink droplet fluctuates due to the heat generated by the electrothermal transducer and accumulated in the recording head, that the electrothermal transducer is adversely affected by cavitation generated when bubbles disappear, and that ink droplet ejection characteristics and image quality are adversely affected by air which is dissolved in the ink and remains in the recording head as remaining bubbles.

The inkjet recording methods and the recording heads disclosed in Japanese Patent Laid-Open Nos. 54-161935, 61-185455, 61-249768, and 4-10941 propose methods of solving these problems. That is, the inkjet recording methods disclosed in the publications described above are such that the bubbles generated by driving an electrothermal transducer in response to a recording signal are communicated with outside air. The employment of the image recording methods stabilizes the volume of a flying ink droplet, makes it to possible to eject a slight amount of an ink droplet at a high speed, and can improve the durability of a heater by eliminating cavitation generated when bubbles disappear, whereby a much finer image can be easily obtained. The publications described above exemplify an arrangement in which the shortest distance between an electrothermal transducer and an ejection port is greatly reduced compared to that of a conventional arrangement as an arrangement for communicating bubbles with outside air.

This type of a conventional recording head will be described below. The conventional recording head includes an element substrate on which electrothermal transducers for ejecting ink are disposed and a nozzle forming member laminated on the element substrate and constituting ink flow paths. The nozzle forming member includes a plurality of ejection ports for ejecting ink droplets, a plurality of nozzles through which ink flows, and a supply chamber for supplying ink to the respective nozzles. Each nozzle has a bubble forming chamber in which bubbles are generated by an electrothermal transducer and a supply path for supplying ink to the bubble forming chamber. The electrothermal transducers are disposed on the element substrate so as to be located in the bubble forming chambers. Further, a supply port is formed on the element substrate to supply ink to the supply chamber from the back surface side of the element substrate that is opposite to the main surface thereof adjacent to the nozzle forming member. Then, ejection ports are formed on the nozzle forming member at positions confronting the electrothermal transducers on the element substrate.

In the conventional recording head arranged as described above, the ink supplied from the supply port into the supply chamber is supplied along the respective nozzles and fill the bubble forming chambers. The ink having filled the bubble forming chambers is flown in a direction approximately perpendicular to the main surface of the element substrate by bubbles that are generated by a film boiling phenomenon caused by heat applied from the electrothermal transducers, and is ejected from the ejection ports as ink droplets.

Then, it is contemplated to further increase the recording speed of a recording apparatus provided with the recording head described above to output a recorded image of higher quality, an image of high quality, an image of high resolution, and the like. To increase the recording speed of a conventional recording apparatus, U.S. Pat. Nos. 4,882,595 and 6,158,843 disclose a trial for increasing the number of times of ejection of ink droplets flown from each nozzle of a recording head, that is, a trial for increasing an ejection frequency.

Further, in a conventional recording head, it is taken into consideration to improve an ejection efficiency such as an amount of ink droplets ejected from ejection ports, an ejection speed thereof, and the like and to improve a refill speed at which bubble forming chambers are filled with ink.

In general, when it is intended to improve the ejection efficiency, that is, the ejection characteristics of a recording head and the refill efficiency, it is important to infinitely increase an quantity of inertance from an electrothermal transducer to an ejection port as compared with a quantity of inertance from the electrothermal transducer to a supply port, as well as to reduce a resistance in a nozzle.

While the inertance and the resistance are varied by the length and cross sectional area of a nozzle, the ejection efficiency and the refill efficiency have been made full use such that they have moderate characteristics because the inertance and the resistance are in a relation of trade-off.

In contrast, high image quality and small droplets are more required from the recent trend of an inkjet system. Accordingly, it is desired to further improve the ejection efficiency and the refill efficiency from the view point of speed-up and energy-saving. However, the ejection efficiency and the refill efficiency have been made full use so as to have the moderate characteristics in the conventional arrangement as described above because the nozzle is arranged to have a straight structure. Thus, there is a limit to further improvement both of the ejection efficiency and the refill efficiency. It should be noted that U.S. Pat. No. 6,158,843 described above discloses an arrangement in which a space and a fluid resistant protruding element are disposed in a supply chamber or in the vicinity of a supply port in order to increase a refill speed and to locally reduce and increase an ink flow path. However, this patent focuses attention only on the improvement of the flow of ink, which is supplied from a supply chamber, in each nozzle and does take into consideration the improvement of the ejection efficiency of, in particular, a nozzle.

SUMMARY OF THE INVENTION

Accordingly, an object of the present invention is to provide a liquid ejection head capable of increasing the ejection speed of liquid droplets, stabilizing the amount (volume) of ejected liquid droplets, and simultaneously improving the ejection efficiency and the refill efficiency of the liquid.

Note that it is difficult to obtain a sufficient effect for the above object by the adjustment of a nozzle length because the nozzle length is variously restricted from the view point of a substrate size and a stroke. Thus, it is advantageous to adjust the sectional area of the nozzle. The extent to which the nozzle width can be adjusted is limited by the recent requirement for disposing electro-thermal transducers at a high density. In such circumstances, the inventors have focused attention on the fact that variation in the height of a nozzle greatly contributes to the improvement of ejection characteristics and refill characteristics.

To achieve the object described above, a liquid ejection head of the present invention has a plurality of ejection energy generation elements for generating energy for ejecting liquid droplets, an element substrate on which the plurality of energy generating elements are disposed, and a nozzle forming member laminated on the main surface of the element substrate and including (1) a plurality of nozzles each having an ejection port for ejecting liquid droplets, a bubble forming chamber in which bubbles are formed by an ejection energy generation element, and a supply path for supplying a liquid to the bubble forming chamber, and (2) a supply chamber for supplying the liquid to the plurality of nozzles, wherein the nozzle forming member has a protrusion, which reduces the height of each nozzle with respect to the main surface of the element substrate in the nozzle, in the vicinity of each ejection energy generation element on the supply path side thereof, and the height of the nozzle changes from the protrusion toward the supply chamber.

The liquid ejection head arranged as described above has a portion where the height of each nozzle is reduced and which is located in the gate electrode vicinity of each ejecting energy generation element on the supply path side thereof, and the height of the nozzle is changed toward the supply chamber, whereby when liquid droplets are ejected, the liquid having filled each bubble forming chamber is suppressed from being pushed out to a supply path by the bubbles generated in the bubble forming chamber. Thus, according to the liquid ejection head, fluctuation in the volume of the liquid droplets ejected from the ejection port can be suppressed, whereby the ejected volume of the liquid droplets can be properly stabilized. Further, according to the liquid ejection head, when a liquid droplet is ejected, it can be suppressed that the bubbles grown in the bubble forming chamber lose the pressure thereof by being abutted against the inner walls of the bubble forming chamber. Thus, according to the liquid ejection head, the ejecting speed of a liquid droplet can be improved because the bubbles in the bubble forming chamber can be excellently grown and the pressure thereof can be sufficiently stabilized.

Further objects, features and advantages of the present invention will become more apparent from the following description of the preferred embodiments with respect to the attached drawings.

DESCRIPTION OF THE PREFERRED EMBODIMENTS

Recording heads for ejecting liquid droplets such as ink of specific embodiments of the present invention will be described below with reference to the drawings.

First, a recording head according to the embodiments will be described. The recording head of the embodiments is a recording head that is particularly provided with a means for generating thermal energy as energy utilized to eject liquid ink in an inkjet recording system and employs a system for changing the state of the ink by the thermal energy. Recorded characters, images, and the like are made denser and finer by the employment of this system. In particular, the embodiments employ a heating resistance element as a means for generating the thermal energy, and ink is ejected making use of a pressure made by bubbles generated when ink is film-boiled by being heated by the heating resistance element.

First Embodiment

Figure 1:
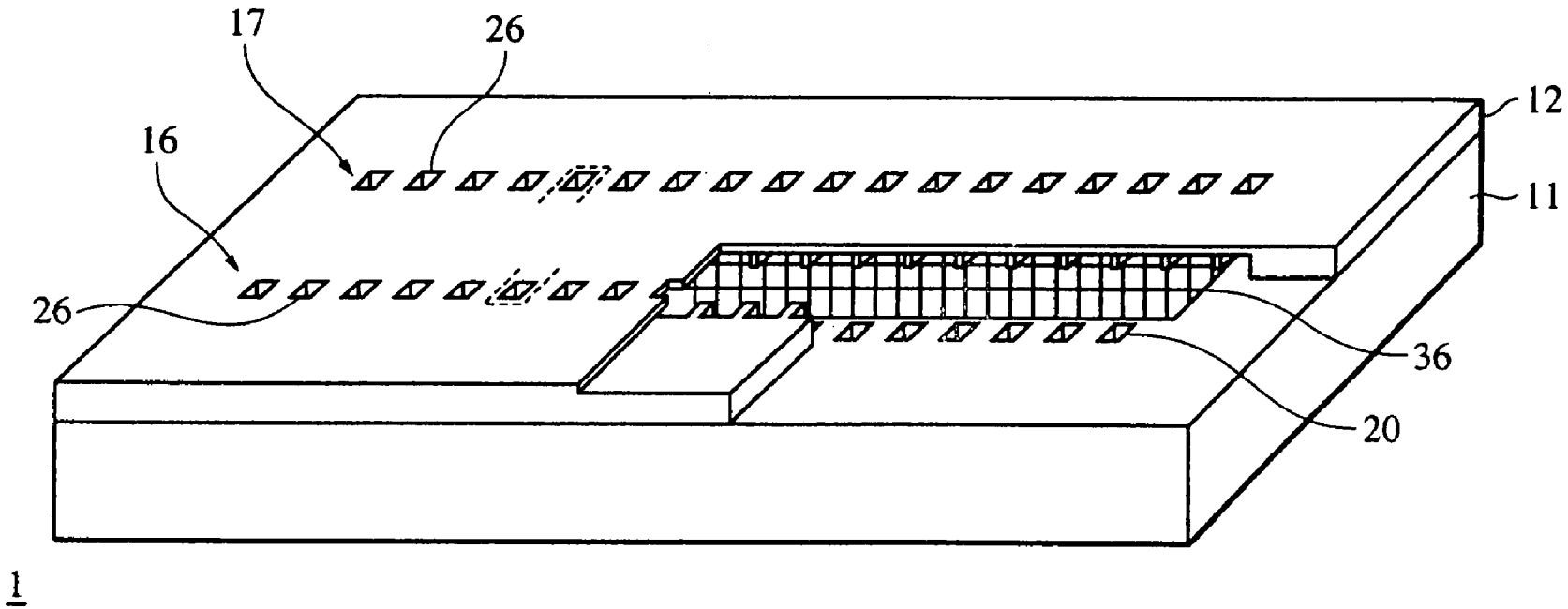
FIG. 1 is a perspective view explaining the outline of a recording head of a first embodiment according to the present invention.

As shown in FIG. 1, a recording head 1 of a first embodiment is arranged such that a partition wall, which independently forms a nozzle acting as an ink flow path for each of a plurality of heaters acting as heating resistance elements, is extended from an ejection port to the vicinity of a supply port. This arrangement will be described later. The recording head 1 has an ink ejection unit to which the inkjet recording method disclosed in Japanese Patent Laid-Open Nos. 4-10940 and 4-10941 is applied, and bubbles generated when ink is ejected are communicated with outside air through the ejection ports.

Then, the recording head 1 includes a first nozzle train 16, which has a plurality of heaters and a plurality of nozzles with the respective nozzles arranged parallel to each other in the long direction thereof, and a second nozzle train 17 disposed at a position confronting the first nozzle train 16 across supply ports. The respective adjacent nozzles of the first and second nozzle trains 16 and 17 have a nozzle pitch set to 600 dpi. Further, the respective nozzles of the second nozzle train 17 are disposed such that the adjacent nozzles thereof are disposed at a pitch displaced by ½ pitch with respect to the respective nozzles of the first nozzle train 16.

An idea for optimizing the recording head 1 including the first and second nozzle trains 16 and 17 in which the plurality of heaters and the plurality of nozzles are highly densely disposed will be briefly described.

In general, an inertance (inertial force) and a resistance (viscous resistance) in a plurality of nozzles disposed densely act as physical quantities that influence the ejecting characteristics of a recording head. A dynamic equation of a non-compressive fluid moving in an arbitrarily-shaped flow path is shown by the following two equations.

$$\Delta\cdot v=0 \text{(equation of continuation)} \qquad \text{Equation 1}$$

$$\delta V/\delta t+(\Delta\cdot v)=-\Delta(P/\rho)+(\mu/\rho)\Delta^2 v+f \text{ (Navier-Stokes equations)} \qquad \text{Equation 2}$$

When Equations 1 and 2 are approximated assuming that a term of convention and a term of viscosity are sufficiently small and that no external force is applied, the following equation can be obtained.

$$\Delta^2=0 \qquad \text{Equation 3}$$

Accordingly, the pressure can be expressed using a harmonic function.

Figure 2:
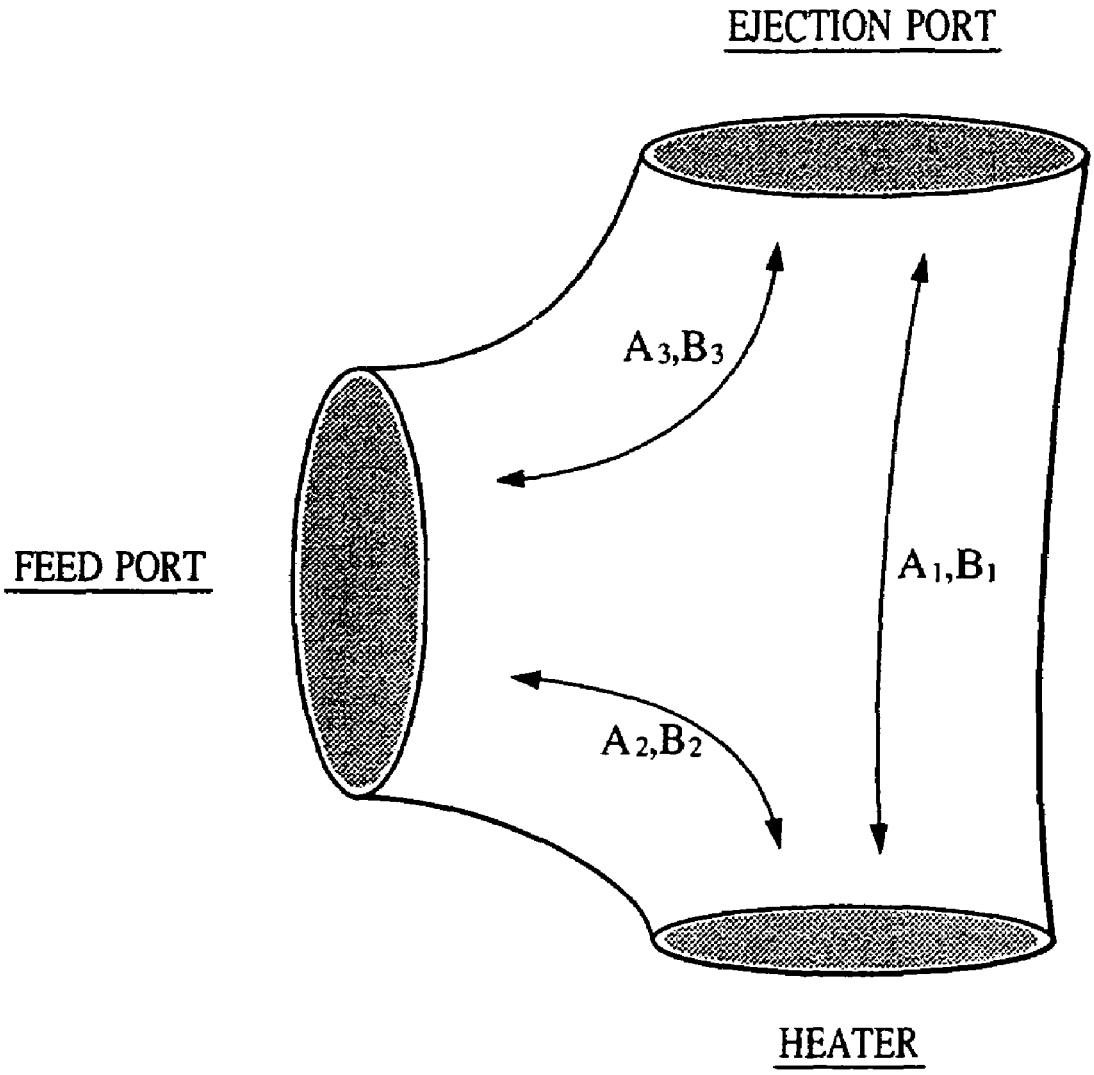
FIG. 2 is a schematic view showing the recording head by a model having three openings.
Figure 3:
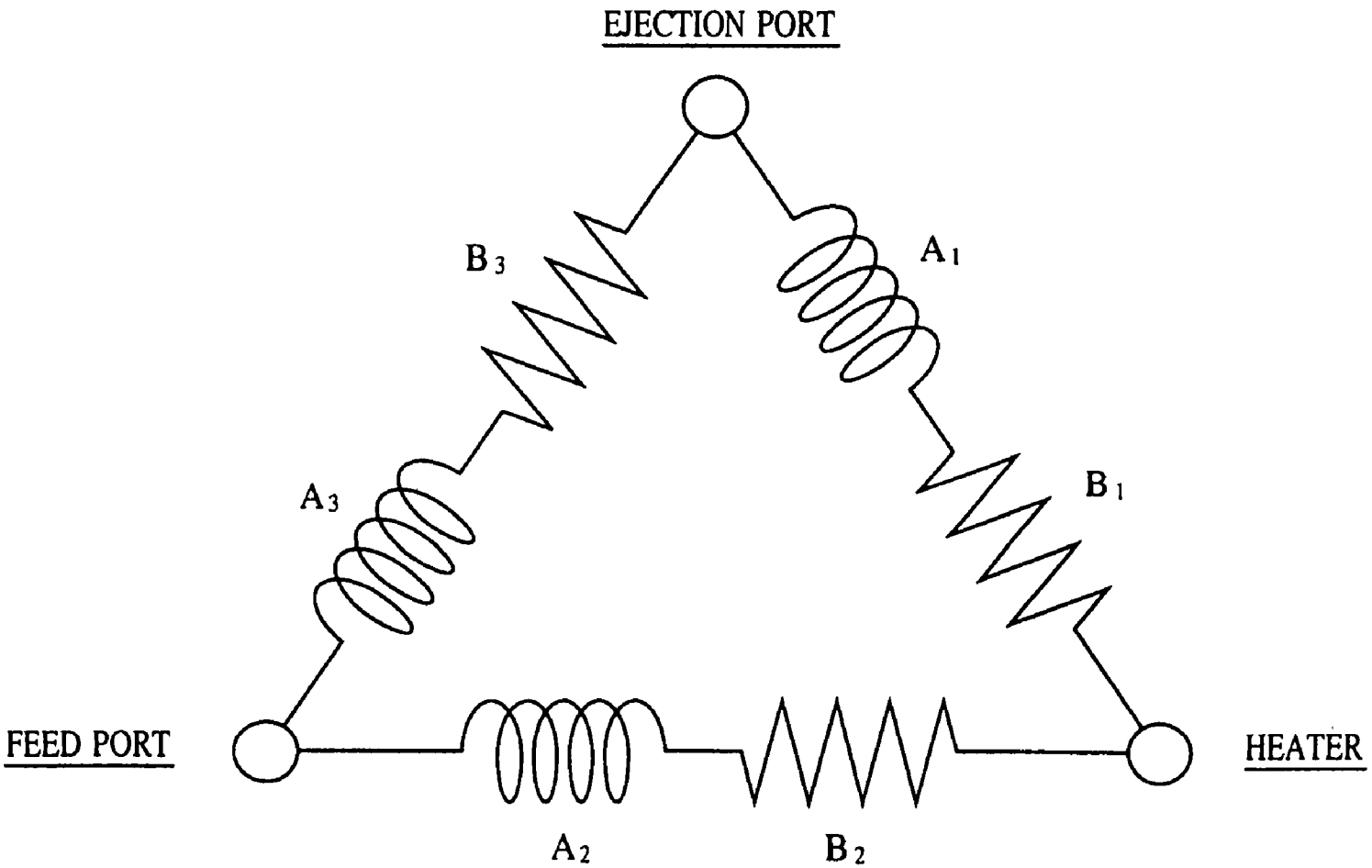
FIG. 3 is a schematic view showing the recording head by an equivalent circuit.

Then, the recording head is shown by a model having three openings as shown in FIG. 2 and by an equivalent circuit as shown in FIG. 3.

The term "inertance" is defined as "difficulty to move" when a stationary fluid suddenly begins to move. When the inertance is shown electrically, it acts as if it is an inductance L that checks the change of a current. In a mechanical spring-mass model, the inertance corresponds to a mass.

When the inertance is shown by an equation, it is shown by a second order time differential of a fluid volume V, that is, by a ratio of a quantity of flow F to a time differential (quantity of flow=ΔV/Δt).

$$(\Delta^2 V/\Delta t^2)=\Delta F/\Delta t=(1-A)\times P \qquad \text{Equation 4}$$

where A shows inertance

When, for example, a pipe-shaped pseud-flow-path having a density ρ, a length L, and a sectional area $S_0$ is assumed, the inertance $A_0$ of the primary pseud-flow-path is shown by the following equation.

$$A_0=\rho\times L/S_0$$

It can be found from the equation that the inertance $A_0$ is proportional to the length of the flow path and inversely proportional to the sectional area thereof.

The ejection characteristics of a recording head can be predicted and analyzed using a model based on an equivalent circuit as shown in FIG. 3.

In the recording head of the present invention, an ejection phenomenon is defined a phenomenon in which a fluid flow shifts from an inertial flow to a viscous flow. In particular, the fluid mainly flows as the inertial flow at the initial stage of formation of bubbles that are formed by a heater in a bubble forming chamber, whereas the fluid mainly flows as the viscous flow at the later stage thereof (that is, from the time at which a meniscus formed in an ejection port begins to move to an ink flow path side to the time at which ink is caused to fill up to the end surface of the opening of the ejection port by a capillary phenomenon and returns). At this time, a quantity of inertance greatly contributes to the ejection characteristics, in particular, to an ejection volume and an ejection speed at the initial stage of bubble formation from the relation of the quantity of inertance, whereas, in the later stage of ejection, a quantity of resistance (viscous resistance) greatly contributes to the ejection characteristics, in particular, to a time necessary to refill ink (hereinafter, referred to as "refill time").

Here, the resistance (viscous resistance) is described as a steady stroke flow expressed by Equations 1 and 5 as shown below, from which the viscous resistance B can be determined.

$$\Delta P=\eta\Delta^2\mu \qquad \text{Equation 5}$$

Further, at the later stage of ejection, ink is caused to flow by the sucking force mainly generated by a capillary force because a meniscus is formed in the vicinity of an ejection port in the model shown in FIG. 2. Thus, the viscous resistance can be approximated using a model having two openings (primary flow model). That is, the resistance viscosity B can be determined from Poiseuille equation describing a viscous fluid.

$$(\Delta V/\Delta t)=(1/G)\times(1/\eta)\{\Delta P/\Delta x)\times S(x)\} \quad \text{Equation 6}$$

where G shows a form factor. Further, since the viscous resistance B is generated by a fluid flowing according to an arbitrary pressure difference, it is determined from the following equation.

$$B=\int_0^L\{(G\times\eta/S(x)\}\Delta x \quad \text{Equation 7}$$

When the pipe-shaped flow path having the density ρ, the length L, and the sectional area $S_0$ is assumed by Equation 7 described above, the resistance (viscous resistance) is shown by the flowing equation.

$$B=8\eta\times L/(\pi\times S_0^2) \quad \text{Equation 8}$$

Thus, the resistance (viscous resistance) B is approximately proportional to the length of a nozzle and inversely proportional to the square of the sectional area of the nozzle.

To improve the ejection characteristics of the recording head, in particular, to improve the ejection speed and ejected volume of an ink droplet and the refill time of ink as described above, it is a necessary and sufficient condition to infinitely increase the quantity of inertance from the heater to the ejection port as compared with the quantity of inertance from the heater to the supply port from the relation of inertance as well as to reduce the resistance in the nozzle.

The recording head according to the present invention can satisfy both the point of view described above and further a thesis for disposing a plurality of heaters and a plurality of nozzles very densely.

Next, a specific arrangement of the recording head according to the embodiment will be described with reference to the drawings.

Figure 4:
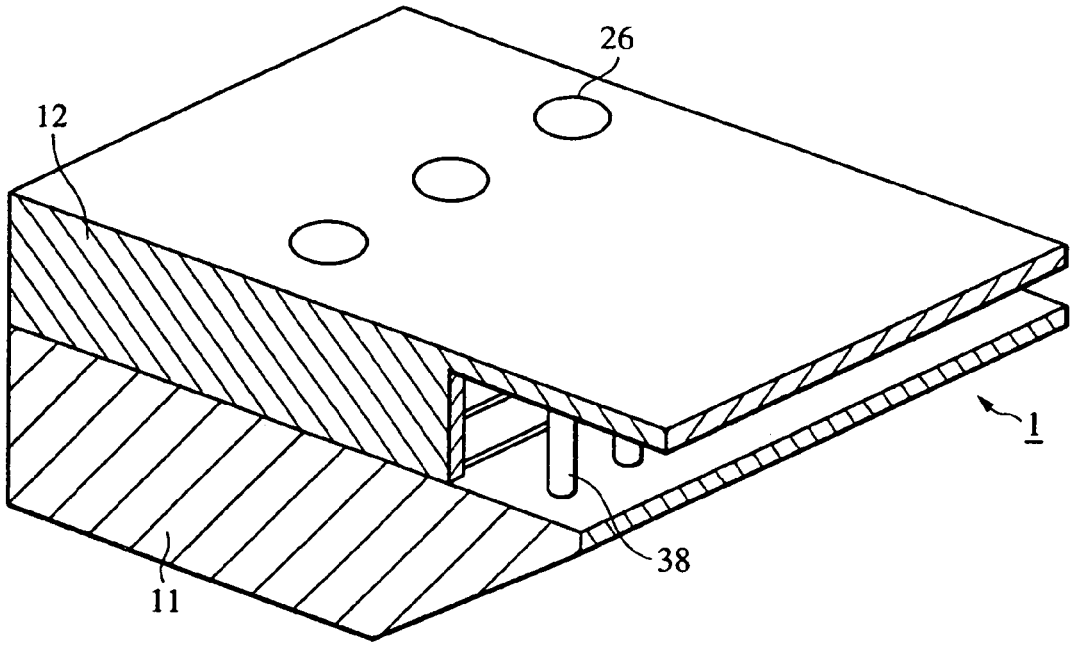
FIG. 4 is a perspective view, partly in cross section, showing the recording head.
Figure 5:
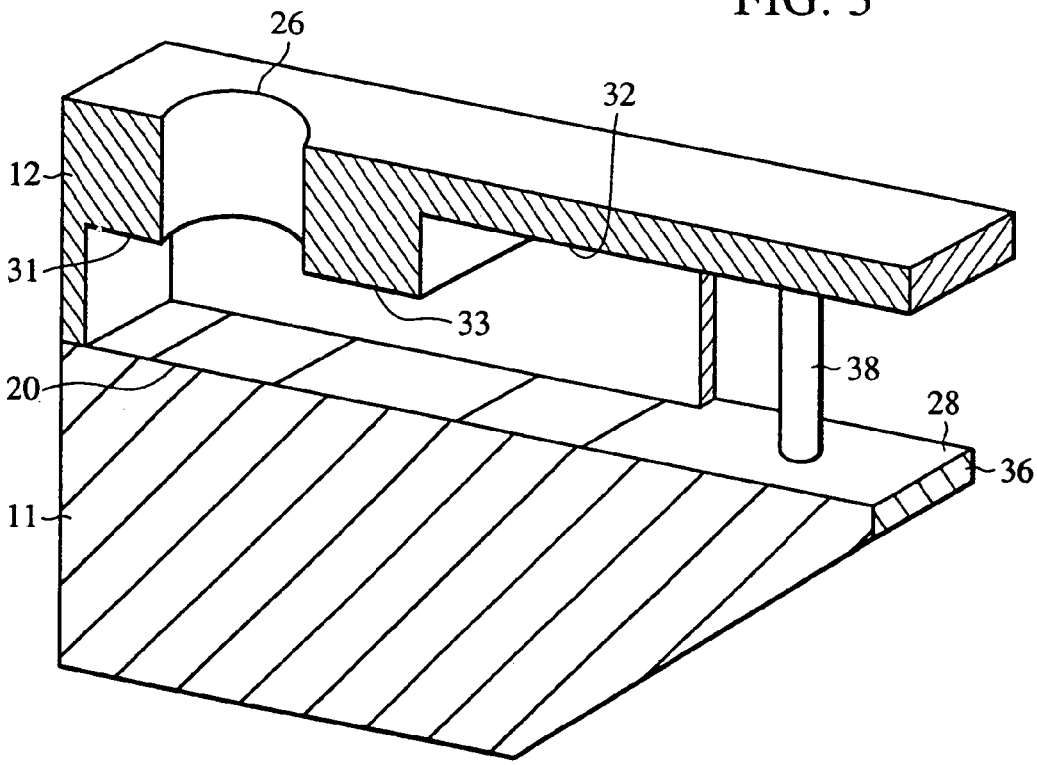
FIG. 5 is a perspective view showing a main portion of the recording head.

As shown in FIGS. 4 and 5, the recording head 1 includes an element substrate 11 on which a plurality of heaters 20 acting as heating resistance elements are disposed and a nozzle forming member 12 laminated on the main surface of the element substrate 11 and constituting a plurality of ink flow paths.

The element substrate 11 is formed of, for example, glass, ceramics, resin, metal, and the like and ordinarily composed of Si.

A heater 20, an electrode (not shown) for applying a voltage to the heater 20, and a wiring (not shown) connected to the electrode are formed on the main surface of the element substrate 11 by a predetermined wiring pattern, respectively for each of the ink flow paths.

Further, an insulation film 21 for improving accumulated heat diffusing property is formed on the main surface of the element substrate 11 so as to cover the heaters 20. Further, a protective film 22 for protecting the element substrate 11 from cavitation when bubbles disappear is formed on the main surface of the element substrate 11 so as to cover the insulation film 21.

The nozzle forming member 12 is composed of a resin material and formed to a thickness of about 30 μm. As shown in FIG. 5, the nozzle forming member includes a plurality of ejection ports 26 for ejecting ink droplets, a plurality of nozzles 27 (see FIGS. 6 and 7) through which ink flows, and a supply chamber 28 for supplying ink to the respective nozzles 27.

The ejection ports 26 are formed at positions on the element substrate 11 where they confront heaters 20 and arranged as circular holes each having a diameter of, for example, about 15 μm. Note that the ejection ports 26 may be formed in a radial and approximate star shape when necessary for the convenience of ejection characteristics.

Figure 6:
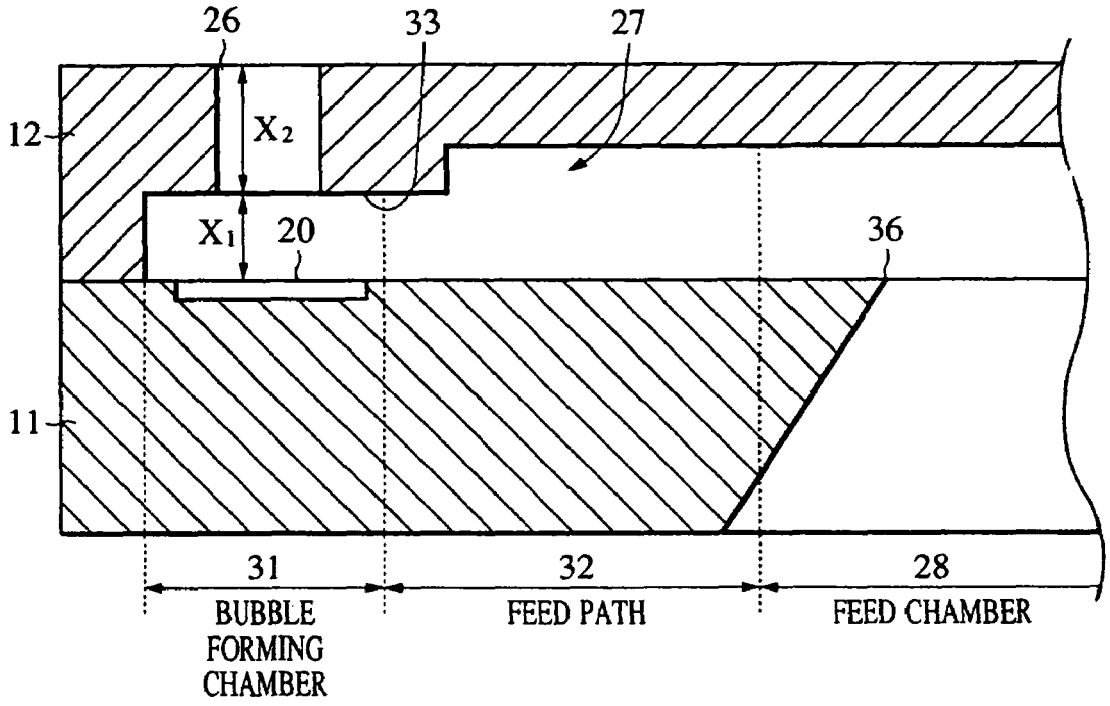
FIG. 6 is a longitudinal sectional view explaining the main portion of the recording head.
Figure 7:
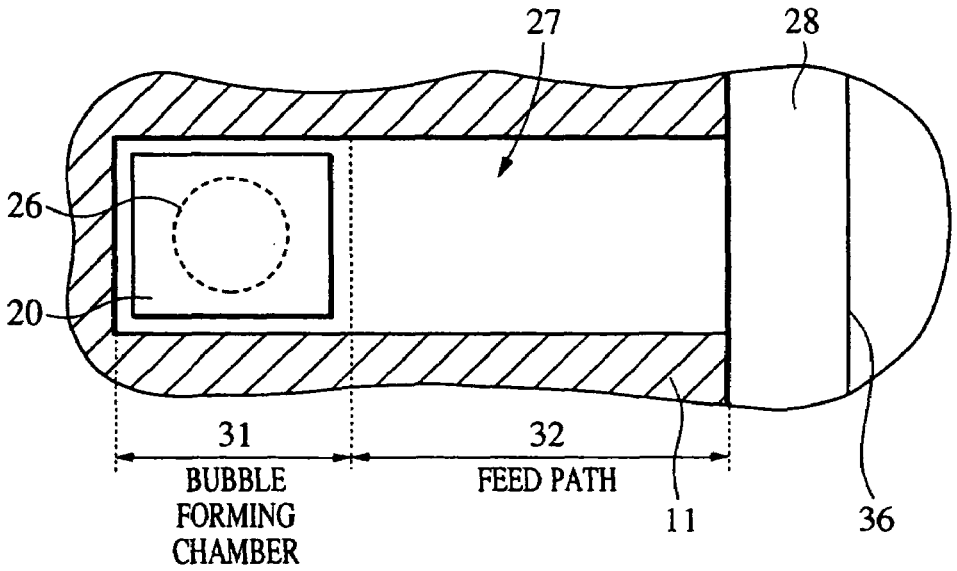
FIG. 7 is a plan view explaining the main portion of the recording head.

As shown in FIGS. 6 and 7, each nozzle 27 has a bubble forming chamber 31 in which bubbles are formed by a heater 20, a supply path 32 for supplying ink into the bubble forming chamber 31, and a control section 33 for controlling the ink in the bubble forming chamber 31 flowed by the bubbles.

The bubble forming chamber 31 is formed such that the bottom surface thereof confronting the ejection port 26 has an approximately rectangular shape. The bubble forming chamber 31 is formed such that the shortest distance $(x_1+x_2)$ between the main surface of the heater 20, which is parallel to the main surface of the element substrate 11, and the ejection port 26 is set to 30 μm or less.

The supply path 32 is formed such that one end thereof is communicated with the bubble forming chamber 31 and the other end thereof is communicated with the supply chamber 28.

The control section 33 is formed stepwise along the flow path parallel to the flow direction of ink as well as on a plane perpendicular to the main surface of the element substrate 11 from the bubble forming chamber 31 to the end of the supply path 32 adjacent to the bubble forming chamber 31, in order to change the height of the nozzle 27 with respect to the main surface of the element substrate 11. In the nozzle 27, the confronting surface of a control section 33 that confronts the main surface of the element substrate 11 is formed continuously to the confronting surface of a bubble forming chamber 31. These confronting surfaces are formed parallel to the main surface of the element substrate 11.

In other words, the control section 33 causes the height of the nozzle 27 with respect to the main surface of the element substrate 11 to be formed smaller than the height thereof at the other end of the supply path 32 adjacent to the supply chamber 28 in the range from the one end of the supply path 32 adjacent to the bubble forming chamber 31 to the bubble forming chamber 31. That is, in the nozzle forming member 12, the height of the surface of the control section 33 confronting the main surface of the element substrate 11 is formed equal to the height $x_1$ of the surface of the bubble forming chamber 31 confronting the main surface of the element substrate 11. Accordingly, the nozzle 27 is formed such that the sectional area of the ink flow path is reduced by the control section 33 from the one end of the supply path 32 adjacent to the bubble forming chamber 31 to the bubble forming chamber 31. Further, the nozzle forming member 12 is formed such that the height $x_1$ of the surface of the bubble forming chamber 31 confronting the main surface of the element substrate 11 is smaller than the distance $x_2$ between the confronting surface of the bubble forming chamber 31 and the ejection port 26 in an ejecting direction.

As shown in FIGS. 5 and 7, the nozzle 27 is formed straight such that the flow path, which is perpendicular to the flow direction of ink from the back surface of the element substrate 11 to the supply port 36 through the supply chamber 28, and which is parallel to the main surface of the element substrate 11, has an approximately similar width from the supply chamber 28 to the bubble forming chamber 31. Further, the respective inner wall surfaces of the nozzle 27 confronting the main surface of the element substrate 11 are formed parallel to the main surface of the element substrate 11, respectively from the supply chamber 28 to the bubble forming chamber 31.

Note that, in the nozzle 27, the height $x_1$ of the surface of the control section 33 confronting the main surface of the element substrate 11 is set to, for example, about 14 μm, and the height of the surface of the supply chamber 28 confronting the main surface of the element substrate 11 is set to, for example, about 22 μm. Further, in the nozzle 27, the length of the control section 33 parallel to the flow direction of ink is set to, for example, about 10 μm.

A supply port 36 is formed on the element substrate 11 on the back surface of the element substrate 11 that is opposite to the main surface thereof adjacent to the nozzle forming member 12 so as to supply ink from the back surface to the supply chamber 28.

Further, a columnar filter 38 stands in each of the nozzles 27 at a position adjacent to the supply port 36 from the element substrate 11 to the nozzle forming member 12 to filtrate and eliminate dust in the ink. The nozzle filter 38 is disposed at a position away from the supply port by, for example, about 20 μm. The respective filters 38 are disposed in the supply chamber 28 at intervals set to, for example, about 10 μm. The nozzle filters 38 prevent the supply paths 32 and the ejection ports 26 from being clogged with dust, whereby excellent ejecting operation can be achieved.

The operation for ejecting ink droplets from the ejection ports 26 in the recording head 1 arranged as described above will now be described.

In the recording head 1, first, the ink having been supplied from the supply port 36 into the supply chamber 28 is supplied to each nozzle 27 of the first and second nozzle trains 16 and 17. The ink having been supplied to the nozzle 27 flows along a supply path 32 and fills a bubble forming chamber 31. The ink having filled the bubble forming chamber 31 is flown in a direction approximately perpendicular to the main surface of the element substrate 11 by the growing pressure of the bubbles generated when ink is film-boiled by a heater 20 and ejected from an ejection port 26 as ink droplets.

When the ink having filled the bubble forming chamber 31 is ejected, a part of the ink in the bubble forming chamber 31 is flowed to a supply path 32 by the pressure of the bubbles generated in the bubble forming chamber 31. In the recording head 1, when a part of the ink in the bubble forming chamber 31 flows to the supply path 32, a control section 33 act as a fluid resistance to the ink flowing from the bubble forming chamber 31 toward the supply chamber 28 through the supply path 32 because the supply path 32 is narrowed by the control section 33. Accordingly, the ink having filled the bubble forming chamber 31 is suppressed from flowing to the supply path 32 by the control section 33 in the recording head 1, whereby the reduction of ink in the bubble forming chamber 31 is prevented and the volume of ejected ink droplets can be favorably stabilized.

If the inertance from the heater 20 to the ejection port 26 is shown by $A_1$, the inertance from the heater 20 to the supply port 36 is shown by $A_2$, and the inertance of the overall nozzle 27 is shown by $A_0$ in the recording head 1, an energy allocation ratio η of the ejection port 26 of the head is shown by the following equation.

$$\eta=(A_1/A_0)=\{A_2/(A_1+A_2)\} \quad \text{Equation 9}$$

Further, the respective inertance values are determined by solving Laplace equation using, for example, a solver of a three-dimensional finite element method.

From the equation described above, the energy allocation ratio η of the ejection port 26 of the head is set to 0.59 in the recording head 1. The recording head 1 can maintain the values of an ejection speed and ejection volume approximately as large as conventional values by setting the energy allocation ratio η to approximately the same value as that of a conventional recording head. Further, it is preferable that the energy allocation ratio η satisfy $0.5 < \eta < 0.8$. When the energy allocation ratio η is less than 0.5, the recording head 1 cannot achieve an excellent ejection speed and excellent volume, whereas when the energy allocation ratio η is more than 0.8, ink cannot excellently flow, and ink cannot be refilled.

Further, when, for example, black dye ink (surface tension: $47.8\times10^{-3}$N/m, viscosity: 1.8 cp, pH: 9.8) is used as ink in the recording head 1, the viscous resistance B in the nozzle 27 can be reduced by about 40% compared to the conventional recording head. The viscous resistance B can be calculated also by, for example, the solver of the three-dimensional finite element method, whereby it can be easily calculated by determining the length and sectional area of the nozzle 27.

Accordingly, the recording head 1 of the present invention can increase the ejection speed by about 40% compared to the conventional recording head, whereby ejection frequency responsiveness of about 25 to 30 KHz can be realized.

A method of manufacturing the recording head 1 arranged as described above will be briefly described with reference to FIGS. 8 and 9.

In the manufacturing method of the recording head 1, the recording head 1 is made through a first step for forming the element substrate 11, a second step for forming a lower resin layer 42 and an upper resin layer 41 on the element substrate 11, respectively to constitute the ink flow paths, a third step for forming a desired nozzle pattern on the upper resin layer 41, and a fourth step for forming a desired nozzle pattern on the lower resin layer 42.

Further, in the manufacturing method of the recording head 1, the recording head 1 is made through a fifth step for forming a covering resin layer 43 acting as the nozzle forming member 12 on the upper and lower resin layers 41 and 42, a sixth step for forming the ejection ports 26 in the covering resin layer 43, a seventh step for forming the supply port 36 in the element substrate 11, and an eighth step for eluting the upper and lower resin layers 41 and 42.

Figures 8A, 8B, 8C, 8D, 8E:
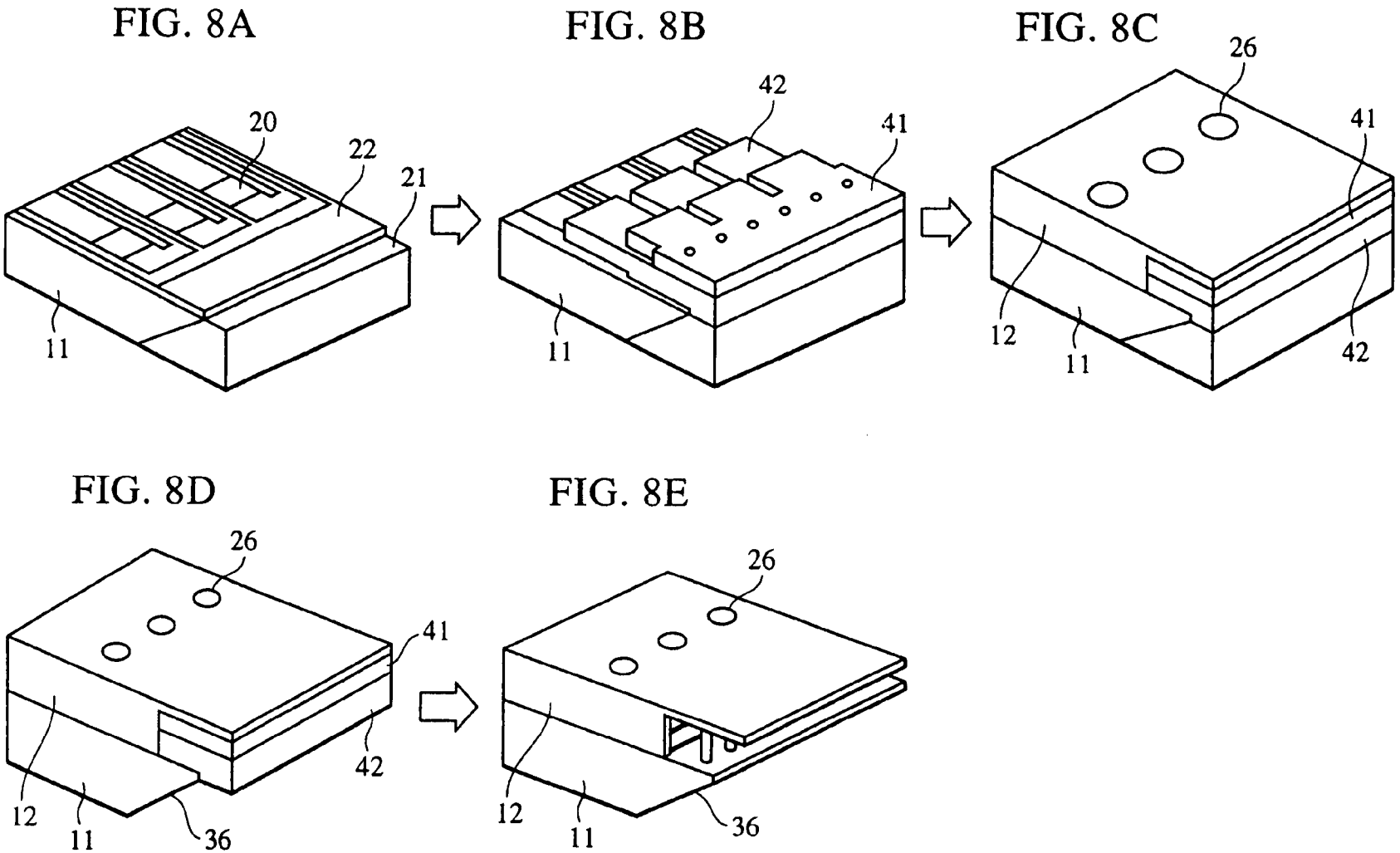
FIGS. 8A to 8E are perspective views explaining a method of manufacturing the recording head.
Figure 9A:
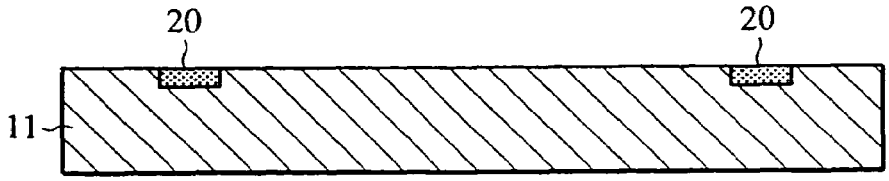
FIGS. 9A to 9E are longitudinal sectional views explaining respective manufacturing steps of the recording head.

As shown in FIGS. 8A and 9A, the first step is a substrate forming step for forming the element substrate 11 by disposing the plurality of heaters 20 and disposing a predetermined wiring for applying a voltage to the heaters 20 by executing pattering processing, and the like on, for example, a Si chip.

Figure 9B:
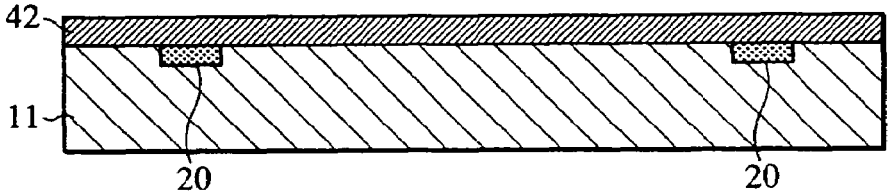
Figure 9C:
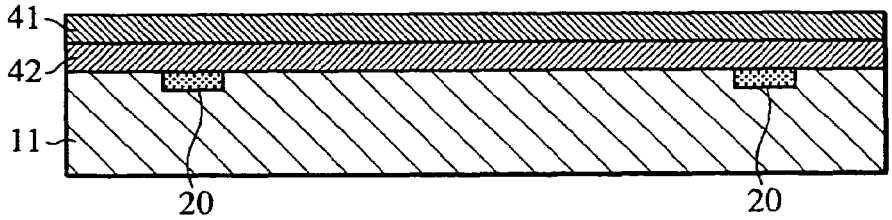

As shown in FIGS. 9B and 9C, the second step is a coating step for continuously coating the lower and upper resin layers 42 and 41 by a spin coating method, the lower and upper resin layers 42 and 41 being made dissolvable in such a manner that the cross-linking bonds of the molecules thereof are broken by irradiating deep UV light (hereinafter, referred to as "DUV" light) as ultraviolet light having a wavelength of 300 nm or less onto the element substrate 11. At the coating step, a thermal linking type resin material is used as the lower resin layer 42. Thus, when the upper resin layer 41 is coated by the spin coating method, the lower resin layer 42 and the upper resin layer 41 are prevented from being dissolved in each other. A liquid obtained by dissolving, for example, polymethyl methacrylate (PMMA) with a cyclohexanone solvent is used as the lower resin layer 42.

Further, a liquid obtained by dissolving, for example, polymethyl isopropenyl ketone (PMIPK) with a cyclohexanone solvent is used as the upper resin layer 41.

Figure 9D:
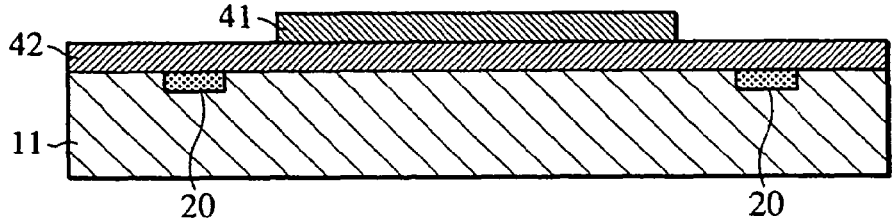

As shown in FIGS. 8B and 9D, the third step is a pattern forming step for forming the desired nozzle pattern on the upper resin layer 41 using an exposure device having a wavelength selection unit such as a reflection mirror mounted thereon that passes only DUV light having a wavelength of about 290 nm therethrough in such a manner that the DUV light having the wavelength of about 290 nm is irradiated onto the upper resin layer 41 and the upper resin layer 41 is exposed and developed thereby. When the nozzle pattern is formed on the upper resin layer 41, the lower resin layer 42 is not exposed to the DUV light and no nozzle pattern is formed on the lower resin layer 42. This is because the sensitivity of the upper resin layer 41 to the DUV light having the wavelength of about 290 nm is greater than the sensitivity of the lower resin layer 42 thereto at a ratio more than about 50:1.

Figure 9E:
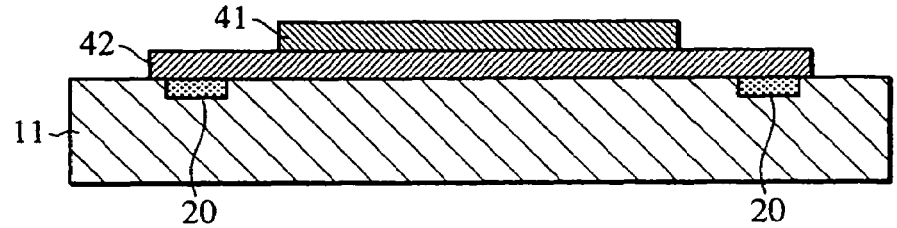

As shown in FIGS. 8B and 9E, the fourth step is a pattern forming step for forming the desired nozzle pattern on the lower resin layer 42 by mounting a wavelength selection unit such as a reflection mirror, which passes only DUV light having a wavelength of about 250 nm therethrough on the exposure device described above, and by exposing and developing the lower resin layer 42 by irradiating only the DUV light having the wavelength of about 250 nm.

Figure 10A:
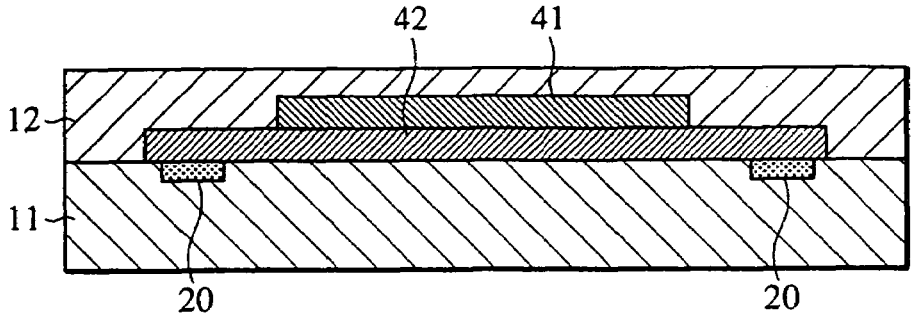
FIGS. 10A to 10D are longitudinal sectional views explaining respective manufacturing steps of the recording head.

The fifth step is a coating step for coating the transparent covering resin layer 43 acting as the nozzle forming member 12 on the upper and lower resin layers 41 and 42, on which the nozzle patterns have been formed and which have been made dissolvable by breaking the cross-linking bonds of the molecules thereof by the DUV light, as shown in FIG. 10A.

Figure 10B:
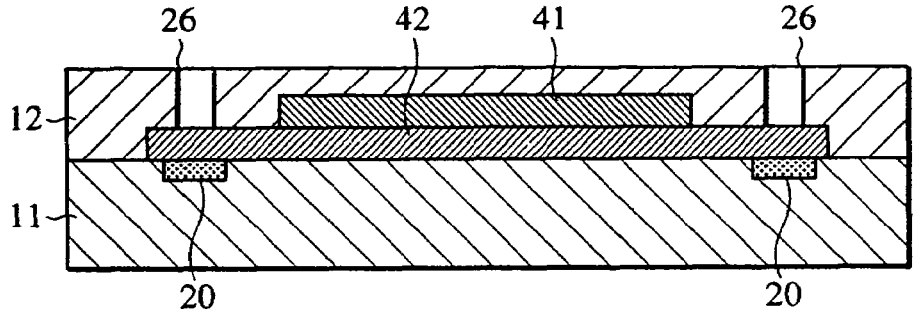

At the sixth step, the nozzle forming member 12 is formed by removing the portions corresponding to the ejection ports 26 by exposing and developing the portions with UV light irradiated to the covering resin layer 43 by the exposure device as shown in FIGS. 8C and 10B.

Figure 10C:
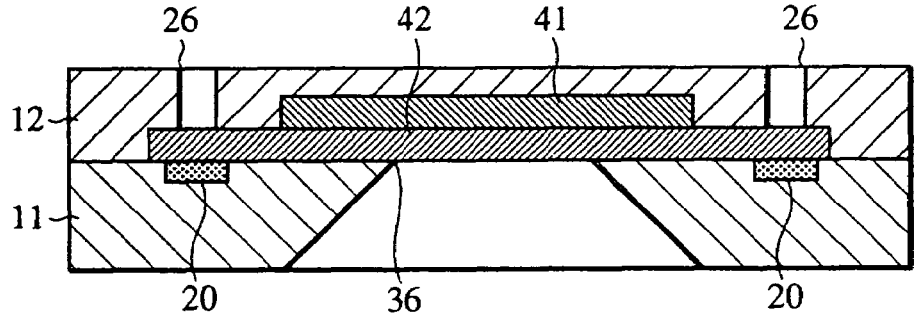

At the seventh step, the supply port 36 is formed in the element substrate 11 by executing chemical etching processing, and the like to the back surface of the element substrate 11 as shown in FIGS. 8D and 10C. Anisotropic etching processing using, for example, a strong alkali solution (KOH, NaH, TMAH) is applied as the chemical etching processing.

Figure 10D:
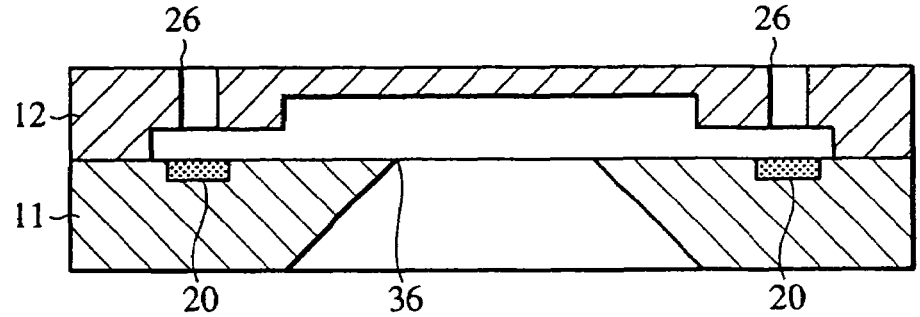

At the eighth step, the upper and lower resin layers 41 and 42 acting as nozzle mold members interposed between the element substrate 11 and the nozzle forming member 12 are eluted, respectively by irradiating DUV light having a wavelength of 300 nm or less from the main surface of the element substrate 11 so as to pass through the covering resin layer 43 as shown in FIGS. 8E and 10D.

Accordingly, there can be obtained the chip provided with the nozzles 27 having the ejection ports 26 and the supply port 36, and the control sections 33 formed in the supply paths 32 that communicate the ejection ports 26 with the supply port 36. The recording head can be obtained by electrically connecting the chip to a wiring substrate (not shown) for driving the heaters 20.

Note that, according to the manufacturing method of the recording head 1 described above, it is possible to provide control sections stepwise that have at least three steps and are formed in the nozzles 27 by further arranging the upper and lower resin layers 41 and 42, which have been made dissolvable by breaking the cross-linking bonds of the molecules thereof by the deep UV light, in a hierarchical structure in the thickness direction of the element substrate 11. For example, a multi-stage nozzle structure can be formed using a resin material having a sensitivity to DUV light having a wavelength of 250 nm or less as a lower layer disposed under the lower resin layer 42.

It is preferable that the manufacturing method of the recording head 1 according to the embodiment basically employ a recording head manufacturing method that uses the inkjet recording method disclosed in Japanese Patent Laid-Open Nos. 4-10940 and 4-10941 as an ink ejection method. These publications disclose an ink droplet ejection method in an arrangement in which the bubbles generated by a heater are communicated with outside air, whereby a recording head capable of ejecting an ink droplet of a minute amount of, for example, 50 pl or less is provided.

In the recording head 1, the volume of an ink droplet ejected from the ejection port 26 greatly depends on the volume of the ink located between the heater 20 and the ejection port 26, that is, on the volume of the ink having filled the bubble forming chamber 31, because bubbles are communicated with outside air. In other words, the volume of an ejected ink droplet is almost determined by the structure of the nozzle 27 portion of the recording head 1.

Accordingly, the recording head 1 can output an image of high quality without irregularity of ink. The recording head of the present invention achieves a maximum effect when it is applied to a recording head in which the shortest distance between a heater and an ejection port is set to 30 μm or less, because bubbles are communicated with outside air in the structure thereof. However, the recording head according to the present invention permits any recording head to operate effectively as long as an ink droplet is flown in a direction perpendicular to the main surface of an element substrate on which the heater is disposed.

As described above, the provision of the control sections 33 for controlling the flow of ink in the bubble forming chambers 31 stabilizes the volume of an ejected ink droplet, whereby the ejection efficiency of ink droplets can be improved.

Second Embodiment

The recording head 1 described above is provided with the control sections 33 for preventing the ink having filled the bubble forming chamber 31 from flowing into the supply paths 32. A second embodiment will describe a recording head 2 having control sections for controlling bubbles, which grow in bubble forming chambers 31, and for controlling the flow of ink flowed by the bubbles. Note that, in the recording head 2, the same components as those used in the recording head 1 described above are denoted by the same reference numerals, and the description thereof is omitted.

Figure 11:
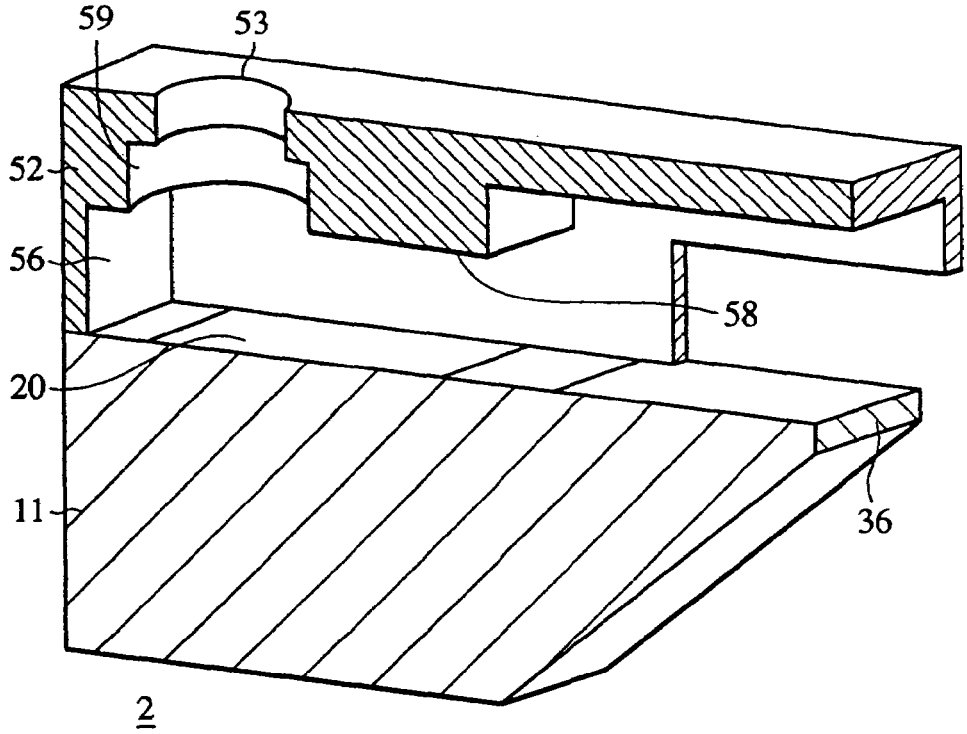
FIG. 11 is a perspective view showing a main portion of a recording head of a second embodiment according to the present invention.
Figure 12:
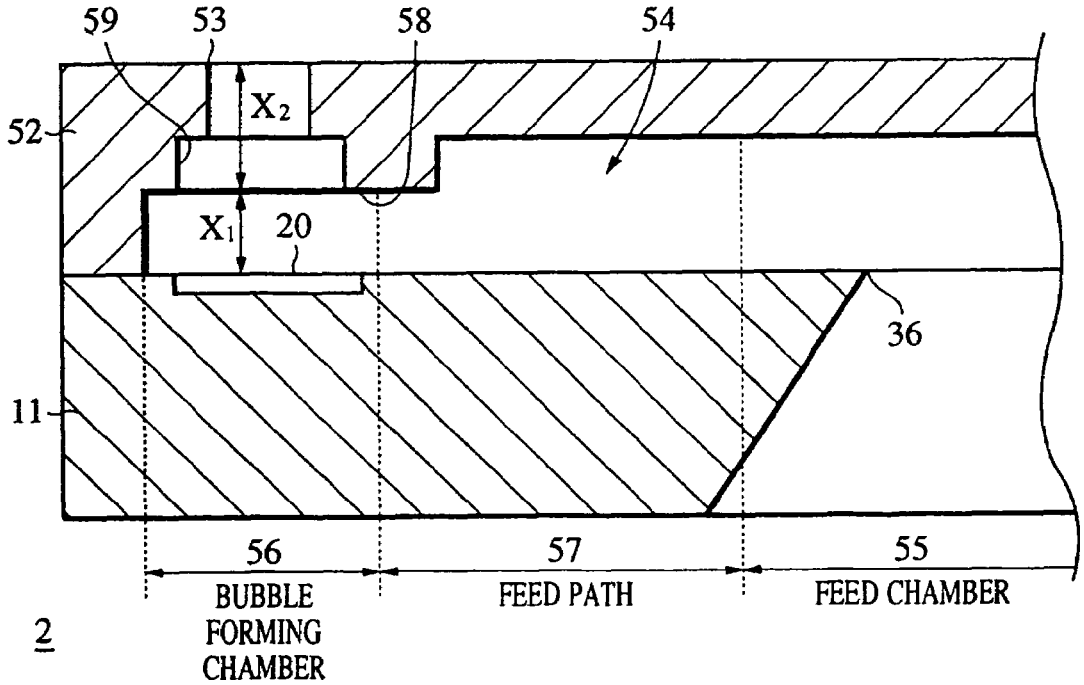
FIG. 12 is a longitudinal sectional view explaining the main portion of the recording head.

As shown in FIG. 11, a nozzle forming member 52 provided with the recording head 2 is formed of a resin material to a thickness of about 30 μm. As shown in FIG. 12, the nozzle forming member 52 includes a plurality of ejection ports 53 for ejecting ink droplets, a plurality of nozzles 54 through which ink flows, and a supply chamber 55 for supplying ink to the respective nozzles 54.

The ejection ports 53 are formed at positions where they confront heaters 20 on the element substrate 11 and arranged as circular holes each having a diameter of, for example, about 15 μm. Note that the ejection ports 53 may be formed in a radial and approximate star shape when necessary for the convenience of ejection characteristics.

Each nozzle 54 has a bubble forming chamber 56 in which bubbles are formed by a heater 20, a supply path 57 for supplying ink into the bubble forming chamber 56, and first and second control sections 58 and 59 for controlling the ink in the bubble forming chamber 56 flowed by the bubbles. The bubble forming chamber 56 is formed such that the bottom surface thereof confronting the ejection port 53 has an approximately rectangular shape. The bubble forming chamber 56 is formed such that the shortest distance ($x_1+x_2$) between the main surface of the heater 20, which is parallel to the main surface of the element substrate 11, and the ejection port 53 is set to 30 μm or less.

The supply path 57 is formed such that one end thereof is communicated with the bubble forming chamber 56 and the other end thereof is communicated with the supply chamber 55.

The first control section 58 is formed stepwise along the flow path parallel to the flow direction of ink as well as on a plane perpendicular to the main surface of the element substrate 11 from the bubble forming chamber 56 to the end of the supply path 57 adjacent to the bubble forming chamber 56 in order to change the height of the flow path with respect to the main surface of the element substrate 11. In the nozzle 54, the confronting surface of a first control section 58 that confronts the main surface of the element substrate 11 is formed continuously to the confronting surface of a second control section 59 in a bubble forming chamber 56. These confronting surfaces are formed parallel to the main surface of the element substrate 11.

In other words, the first control section 58 causes the height of the nozzle 54 with respect to the main surface of the element substrate 11 to be formed smaller than the height thereof at the other end of the supply path 57 adjacent to the supply chamber 55 in the range from the end of the supply path 57 adjacent to the bubble forming chamber 56 to the bubble forming chamber 56. Accordingly, the nozzle 54 is formed such that the sectional area of the ink flow path is reduced by the first control section 58 from the end of the supply path 57 adjacent to the bubble forming chamber 56 to the bubble forming chamber 56.

As shown in FIG. 11, the nozzle 54 is formed straight such that the flow path, which is perpendicular to the flow direction of ink from the back surface of the element substrate 11 to the supply port 36 through the supply chamber 55, and which is parallel to the main surface of the element substrate 11, has an approximately similar width from the supply chamber 55 to the bubble forming chamber 56. Further, the respective inner surfaces of the nozzle 54 confronting the main surface of the element substrate 11 are formed parallel to the main surface of the element substrate 11, respectively from the supply chamber 55 to the bubble forming chamber 56. Note that the nozzle 54 is formed such that the height of the surface of the first control section 58 confronting the main surface of the element substrate 11 is set to, for example, about 14 μm, and the height of the surface of the supply chamber 55 confronting the main surface of the element substrate 11 is set to, for example, about 22 μm. Further, in the nozzle 54, the length of the first control section 58 parallel to the flow direction of ink is set to, for example, about 10 μm.

The second control section 59 is continued to the first control section 58 as well as is continued in the ejecting direction of the ejection port 53 and is formed to increase the opening area of the ejection port 53 stepwise from the ejection port 53 toward the surface of the bubble forming chamber 56 confronting the main surface of the element substrate 11. In other words, the second control section 59 is formed as a circular recess continuous to the ejection port 53. Further, the nozzle forming member 52 is formed such that the height $x_1$ of the surface of the bubble forming chamber 56 confronting the main surface of the element substrate 11 is smaller than the distance $x_2$ between the confronting surface of the bubble forming chamber 56 and the ejection port 53 in the ejecting direction. Note that the nozzle 54 is formed such that the height of the surface of the second control section 59 confronting the main surface of the element substrate 11 is set to, for example, about 24 μm. Further, the inside diameter of the second control section 59 is set to, for example, about 20 μm.

The operation for ejecting ink from the ejection port 53 will now be described as to the recording head 2 arranged as described above.

In the recording head 2, first, the ink having been supplied from a supply port 36 into a supply chamber 55 is supplied to each nozzle 54 of the first and second nozzle trains. The ink having been supplied to the nozzle 54 flows along a supply path 57 and fills a bubble forming chamber 56. The ink having filled the bubble forming chamber 56 is flown in a direction approximately perpendicular to the main surface of the element substrate 11 by the growing pressure of the bubbles generated when ink is film-boiled by a heater 20, and is ejected from an ejection port 53 as ink droplets.

When the ink having filled the bubble forming chamber 56 is ejected, a part of the ink in the bubble forming chamber 56 is flowed to a supply path 57 by the pressure of the bubbles generated in the bubble forming chamber 56. In the recording head 2, when a part of the ink in the bubble forming chamber 56 flows to the supply path 57, a first control section 58 acts as a fluid resistance to the ink flowing from the bubble forming chamber 56 toward the supply chamber 55 through the supply path 57 because the supply path 57 is narrowed by the first control section 58. Accordingly, the ink having filled the bubble forming chamber 56 is suppressed from flowing to the supply path 57 by the first control section 58 in the recording head 2, whereby the reduction of ink in the bubble forming chambers 56 is prevented and the volume of ejected ink droplets can be favorably stabilized.

Further, bubbles are favorably grown in the recording head 2 because the bubbles having grown in the bubble forming chambers 56 are prevented from losing their pressure by being abutted against the inner walls of the bubble forming chambers 56. Accordingly, the recording head 2 can increase the ejection speed of ink droplets ejected from the ejection ports 53.

When an inertance A and viscous resistance B derived from the structure of the nozzles 54 are determined, respectively, similarly to the recording head 1 of the first embodiment described above, the energy allocation ratio η of the ejection ports 53 of the recording head 2 of the second embodiment can be improved by about 30% and the viscous resistance value B thereof can be reduced by about 20% compared to those of the recording head 1 of the first embodiment. Further, the energy allocation ratio η of the ejection ports 53 of the recording head 2 is 0.68.

Accordingly, the recording head 2 can improve an ejection efficiency because the kinetic energy of an ink droplet calculated from the ejection speed and ejection volume thereof is more improved than those of the conventional recording head and the ejection frequency characteristics can be improved similarly to the recording head 1 described above.

Figure 13B:
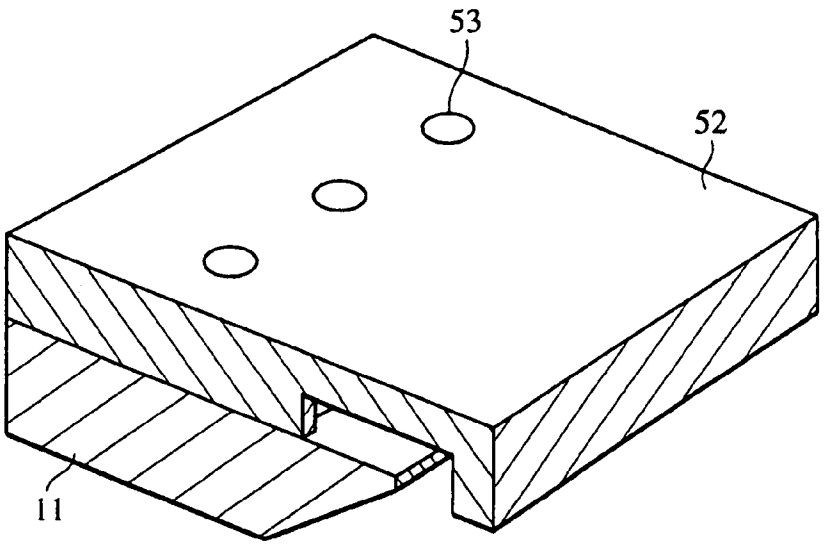
FIGS. 13A and 13B are perspective views explaining a method of manufacturing the recording head.
Figure 13A:
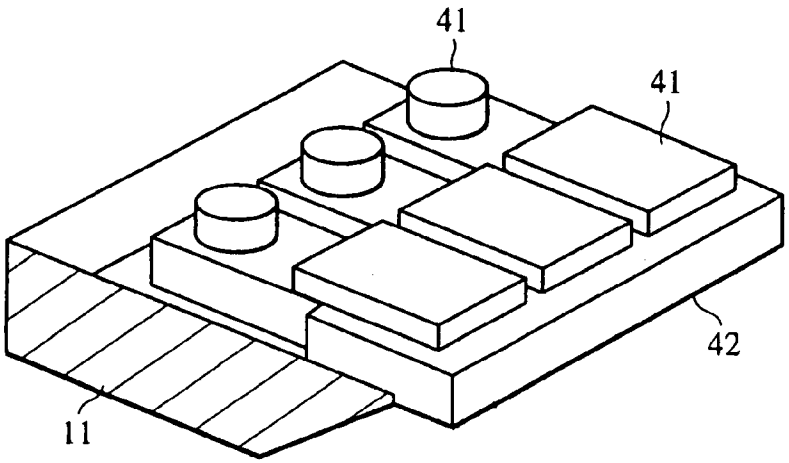

A method of manufacturing the recording head 2 arranged as described above will now be briefly described. Since the manufacturing method of the recording head 2 is approximately similar to that of the recording head 1 described above, the same components are denoted by the same reference numerals, and the description of the same manufacturing steps is omitted. The manufacturing method of the recording head 2 is based on that of the recording head 1 described above, and the manufacturing steps of the recording head 2 are the same as those of the recording head 1 except for a pattern forming step for forming a nozzle pattern on an upper resin layer 41. In the manufacturing method of the recording head 2, the nozzle pattern of the upper resin layer 41 is formed at a predetermined position on a lower resin layer 42 corresponding to the ejection ports 53 to form the second control sections as shown in FIGS. 13A and 13B. That is, the manufacturing method of the recording head 2 can easily form the recording head 2 only by partly changing the shape of the nozzle pattern of the upper resin layer 41.

According to the recording head 2 described above, it is possible to stabilize the ejection volume by the first and second control sections 58 and 59 as well as to further increase the ejection speed of the ink droplets, whereby the ejection efficiency of ink can be further improved.

Third Embodiment

A recording head 3 of a third embodiment in which the height of first control sections 58 of the recording head 2 is more reduced will be briefly described with reference to the drawings. Note that, in the recording head 3, the same components as those of the recording heads 1 and 2 described above are denoted by the same reference numerals, and the description thereof is omitted.

Figure 14:
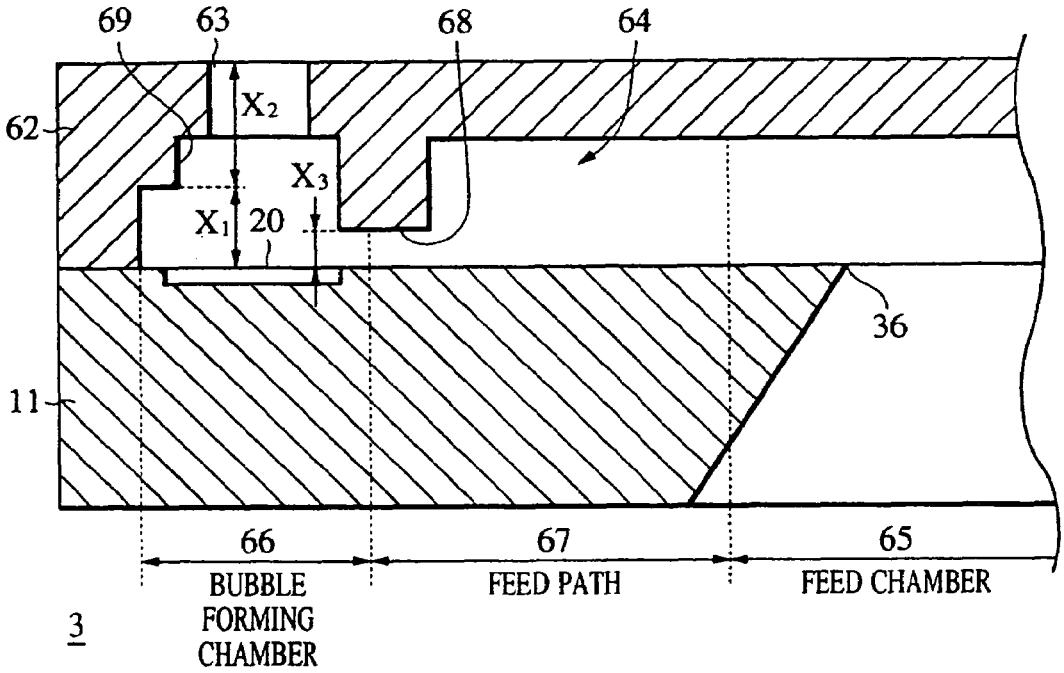
FIG. 14 is a perspective view explaining a main portion of a recording head of a third embodiment according to the present invention.

As shown in FIG. 14, a nozzle forming member 62 provided with the recording head 3 is formed of a resin material to a thickness of about 30 μm. The nozzle forming member 62 includes a plurality of ejection ports 63 for ejecting ink droplets, a plurality of nozzles 64 through which ink flows, and a supply chamber 65 for supplying ink to the respective nozzles 64.

The ejection ports 63 are formed at positions where they confront heaters 20 on an element substrate 11 and arranged as circular holes each having a diameter of, for example, about 15 μm. Note that the ejection ports 63 may be formed in a radial and approximate star shape when necessary for the convenience of ejection characteristics.

Each nozzle 64 has a bubble forming chamber 66 in which bubbles are formed by a heater 20, a supply path 67 for supplying ink into the bubble forming chamber 66, and first and second control sections 68 and 69 for controlling the ink in the bubble forming chamber 66 flowed by the bubbles.

The bubble forming chamber 66 is formed such that the bottom surface thereof confronting the ejection port 63 has an approximately rectangular shape. The bubble forming chamber 66 is formed such that the shortest distance $(x_1+x_2)$ between the main surface of the heater 20, which is parallel to the main surface of the element substrate 11, and the ejection port 63 is 30 μm or less.

The supply path 67 is formed such that one end thereof is communicated with the bubble forming chamber 66 and the other end thereof is communicated with the supply chamber 65.

The first control section 68 is formed stepwise along the flow path parallel to the flow direction of ink as well as on a plane perpendicular to the main surface of the element substrate 11 from the bubble forming chamber 66 to the end of the supply path 67 adjacent to the bubble forming chamber 66 in order to change the height of the flow path with respect to the main surface of the element substrate 11. In the nozzle 64, the confronting surface of a first control section 68 that confronts the main surface of the element substrate 11 is formed continuously to the confronting surface of a second control section 69 in a bubble forming chamber 66. These confronting surfaces are formed parallel to the main surface of the element substrate 11.

In other words, the first control section 68 causes the height of the nozzle 64 with respect to the main surface of the element substrate 11 to be formed smaller than the height of the first control section 58 of the recording head 2 of the second embodiment described above in the range from the end of the supply path 67 adjacent to the bubble forming chamber 66 to the bubble forming chamber 66 as well as be formed smaller than the height of the other end of the supply path 67 adjacent to the supply chamber 65. Accordingly, the nozzle 64 is formed such that the sectional area of the ink flow path is reduced by the first control section 68 from the end of the supply path 67 adjacent to the bubble forming chamber 66 to the bubble forming chamber 66, whereby the nozzle 64 is made smaller than the nozzle 54 of the recording head 2.

The nozzle 64 is formed straight such that the flow path, which is perpendicular to the flow direction of ink from the back surface of the element substrate 11 to the supply port 36 through the supply chamber 65, and which is parallel to the main surface of the element substrate 11, has an approximately similar width from the supply chamber 65 to the bubble forming chamber 66. Further, the respective inner surfaces of the nozzle 64 confronting the main surface of the element substrate 11 are formed parallel to the main surface of the element substrate 11, respectively from the supply chamber 65 to the bubble forming chamber 66.

Note that the nozzle 64 is formed such that the height $x_3$ of the surface of the first control section 68 confronting the main surface of the element substrate 11 is set to, for example, about 10 μm, and the height of the surface of the supply chamber 65 confronting the main surface of the element substrate 11 is set to, for example, about 22 μm. Further, in the nozzle 64, the length of the first control section 68 parallel to the flow direction of ink is set to, for example, about 10 μm.

The second control section 69 is continued to the first control section 68 as well as is continued in the ejecting direction of the ejection port 63 and is formed to increase the opening area of the ejection port 63 stepwise from the ejection port 63 toward the surface of the bubble forming chamber 66 confronting the main surface of the element substrate 11. In other words, the second control section 69 is formed as a circular recess continuous to the ejection port 63. Further, the nozzle forming member 62 is formed such that the height $x_1$ of the surface of the bubble forming chamber 66 confronting the main surface of the element substrate 11 is smaller than the distance $x_2$ between the confronting surface of the bubble forming chamber 66 and the ejection port 63 in the ejecting direction. Note that the nozzle 64 is formed such that the height of the surface of the second control section 69 confronting the main surface of the element substrate 11 is set to, for example, 24 pm. Further, the inside diameter of the second control section 69 is set to, for example, about 20 μm.

The operation for ejecting ink from the ejection port 63 will now be described as to the recording head 3 arranged as described above.

In the recording head 3, first, the ink having been supplied from a supply port 36 into a supply chamber 65 is supplied to each nozzle 64 of the first and second nozzle trains. The ink having been supplied to the nozzle 64 flows along a supply path 67 and fills a bubble forming chamber 66. The ink having filled the bubble forming chamber 66 is flown in a direction approximately perpendicular to the main surface of the element substrate 11 by the growing pressure of the bubbles generated when the ink is film-boiled by a heater 20, and is ejected from an ejection port 63 as ink droplets.

When the ink having filled the bubble forming chamber 66 is ejected, a part of the ink in the bubble forming chamber 66 is flowed to a supply path 67 by the pressure of the bubbles generated in the bubble forming chambers 66. In the recording head 3, when a part of the ink in the bubble forming chamber 66 flows to the supply path 67, the first control section 68 acts as a fluid resistance to the ink flowing from the bubble forming chambers 66 toward the supply chamber 65 through the supply path 67 because the supply path 67 is narrowed by the first control section 68. Accordingly, the ink having filled the bubble forming chamber 66 is more suppressed from flowing to the supply path 67 by the first control section 68 in the recording head 3, whereby the reduction of ink in the bubble forming chamber 66 is prevented and the volume of ejected ink droplets can be more favorably stabilized.

Further, bubbles are favorably grown in the recording head 3 because the bubbles grown in the bubble forming chambers 66 are prevented from losing their pressure by being abutted against the inner walls of the bubble forming chambers 66. Accordingly, the recording head 3 can increase the ejection speed of ink droplets ejected from the ejection ports 63.

According to the recording head 3 described above, the provision of the first control sections 68 in the nozzles suppresses the flow of the ink having filled the bubble forming chambers 66 to the supply paths 67 more than is the case in the recording heads 1 and 2, whereby the ejection efficiency of the ink droplets can be further improved.

Fourth Embodiment

In the recording heads 1 and 2 described above, the flow paths of ink from the supply chambers 28 and 55 to the bubble forming chambers 31 and 56 are formed in a straight shape and have approximately a similar width. However, as will be described with reference to the drawings, in recording heads 4 and 5 of the fourth and fifth embodiments, the width of the ink flow paths changes stepwise. Note that, in the recording head 4, the same components as those of the recording head 1 described above are denoted by the same reference numerals, and the description thereof is omitted. Further, in the recording head 5, the same components as those of the recording head 2 described above are denoted by the same reference numerals, and the description thereof is omitted.

Figure 15:
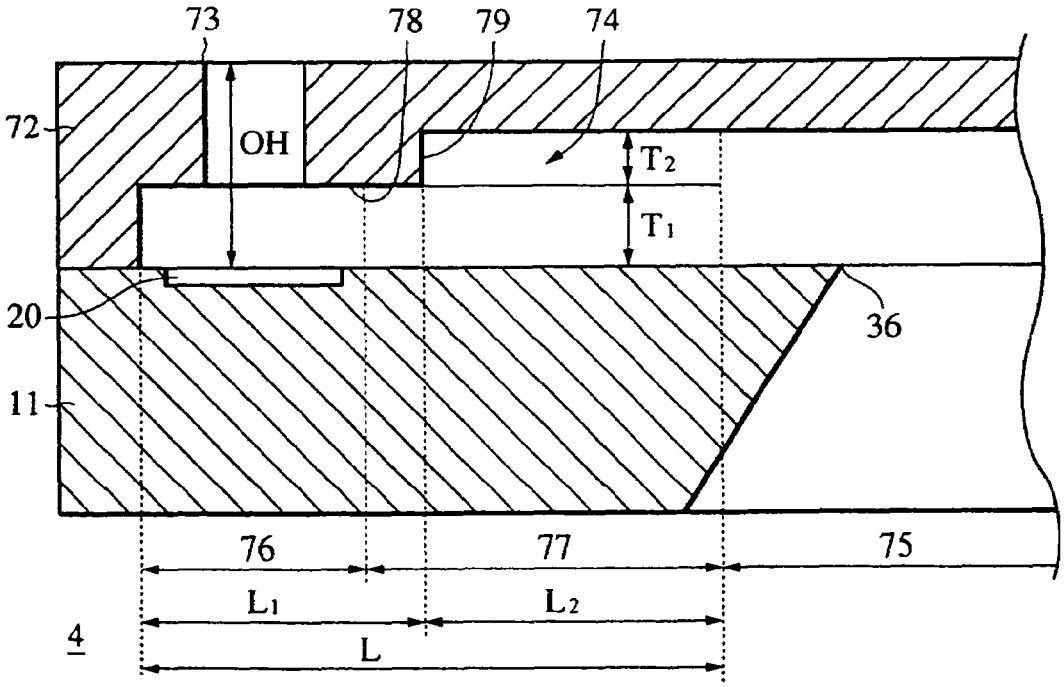
FIG. 15 is a longitudinal sectional view explaining a main portion of a recording head of a fourth embodiment according to the present invention.
Figure 16:
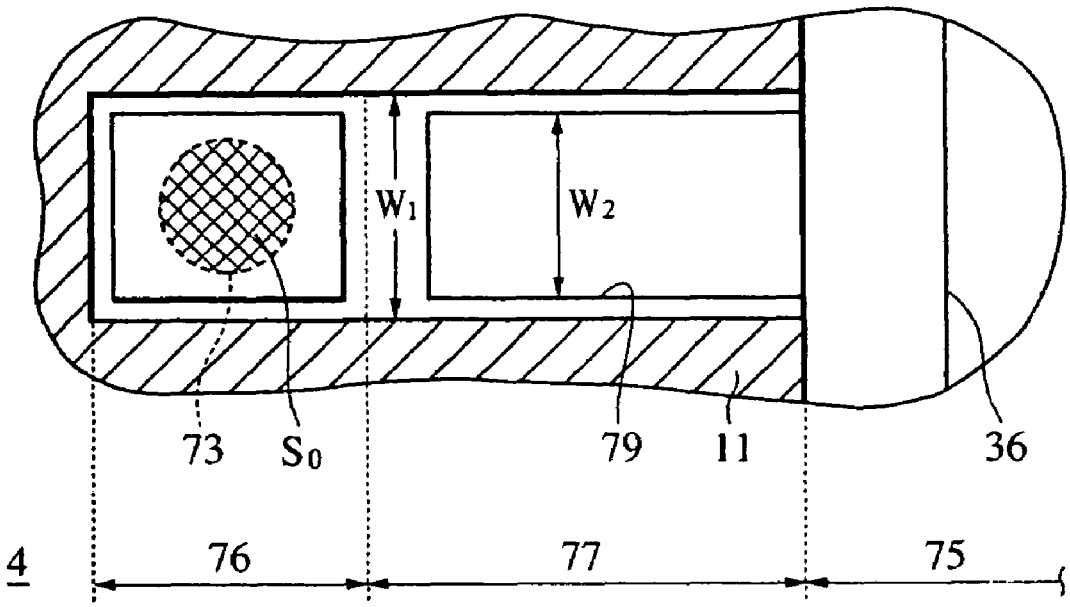
FIG. 16 is a plan view explaining the main portion of the recording head.
Figure 17:
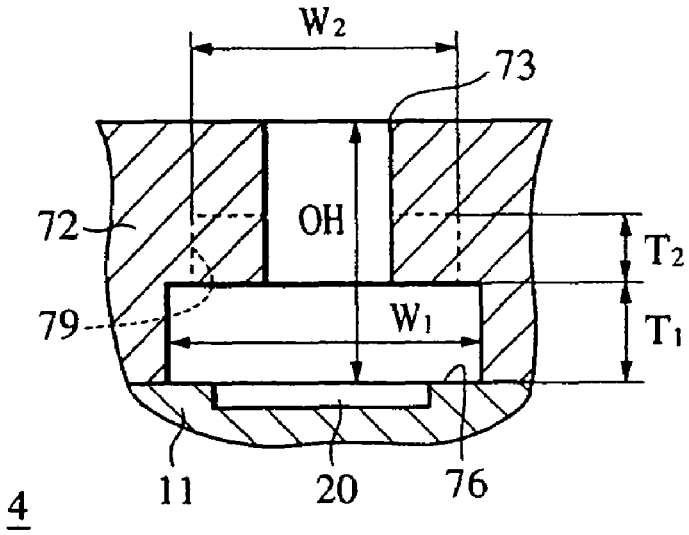
FIG. 17 is a lateral sectional view explaining the main portion of the recording head.

As shown in FIGS. 15, 16 and 17, a nozzle forming member 72 provided in the recording head 4 is formed of a resin material to a thickness of about 30 μm. The nozzle forming member 72 includes a plurality of ejection ports 73 for ejecting ink droplets, a plurality of nozzles 74 through which ink flows, and a supply chamber 75 for supplying ink to the respective nozzles 74.

The ejection ports 73 are formed at positions where they confront heaters 20 on an element substrate 11 and are arranged as circular holes each having a diameter of, for example, about 15 μm. Note that the ejection ports 73 may be formed in a radial and approximate star shape when necessary for the convenience of ejection characteristics.

Each nozzle 74 has a bubble forming chamber 76 in which bubbles are formed by a heater 20, a supply path 77 for supplying ink into the bubble forming chamber 76, and first and second control sections 78 and 79 for controlling the ink in the bubble forming chamber 76 flowed by the bubbles.

The bubble forming chamber 76 is formed such that the bottom surface thereof confronting the ejection port 73 has an approximately rectangular shape. The bubble forming chamber 76 is formed such that the shortest distance OH between the main surface of the heater 20, which is parallel to the main surface of the element substrate 11, and the ejection port 73 is set to 30 μm or less.

The supply path 77 is formed such that one end thereof is communicated with the bubble forming chamber 76 and the other end thereof is communicated with the supply chamber 75.

The first control section 78 is formed stepwise along the flow path parallel to the flow direction of ink as well as on a plane perpendicular to the main surface of the element substrate 11 from the bubble forming chamber 76 to the end of the supply path 77 adjacent to the bubble forming chamber 76 in order to change the height of the flow path with respect to the main surface of the element substrate 11. In the nozzle 74, the confronting surface of a first control section 78 that confronts the main surface of the element substrate 11 is formed continuously to the confronting surface of a bubble forming chamber 76. These confronting surfaces are formed parallel to the main surface of the element substrate 11.

In other words, the first control section 78 causes the height of the nozzle 74 with respect to the main surface of the element substrate 11 to be formed smaller than the height thereof at the other end of the supply path 77 adjacent to the supply chamber 75, in the range from the end of the supply path 77 adjacent to the bubble forming chamber 76 to the bubble forming chamber 76. Accordingly, the nozzle 74 is formed such that the sectional area of the ink flow path is reduced by the first control section 78 from the end of the supply path 77 adjacent to the bubble forming chamber 76 to the bubble forming chamber 76.

The second control section 79 is located on the confronting surface side of the supply path 77 that confronts the main surface of the element substrate 11 and is formed stepwise such that the width of the flow path changes in the thickness direction of the nozzle forming member 72 on a plane perpendicular to the flow direction of ink.

The second control section 79 is formed continuous to the first control section 78 in the long direction of the flow path of the supply path 77. Further, the respective inner surfaces of the nozzles 74 confronting the main surface of the element substrate 11 are formed parallel to the main surface of the element substrate 11, respectively from the supply chamber 75 to the bubble forming chamber 76.

In the recording head 4 arranged as described above, the shortest distance between the main surface of the heater 20 and the ejection port 73 is shown by OH, the opening area of the ejection port ejection port 73 is shown by $S_0$, and the distance between the end of the supply path 77 adjacent to the supply chamber 75 and the end surface of the bubble forming chamber 76 that is parallel to a plane perpendicular to the flow direction of the ink in the supply path 77 is shown by L as shown in FIGS. 15 and 16.

Further, in the recording head 4, if the height of the first control section 78 is shown by $T_1$, the difference between the height of the supply path 77 and the height $T_1$ of the first control section 78 is shown by $T_2$, the width of the flow path having the height $T_1$ is shown by $W_1$, the width of the flow path corresponding to the difference $T_2$ is shown by $W_2$, the length of the flow path having the height $T_2$ in the flow direction is shown by $L_1$, and the length of the flow path corresponding to the difference $T_2$ in the flow direction is shown by $L_2$, the respective volumes of the nozzle 74 are formed to satisfy the following inequality.

$$\{S_0\times(OH-T_1)\}<(L_1\times W_1\times T_1)<\{L_2\times(W_1\times T_1+W_2T_2\}$$

where $L=L_1+L_2$ and $W_1>W_2$

When a plurality of control sections are continuously disposed stepwise in the nozzle, they are shown by first to n-th control sections toward the upstream side of the flow path. Then, the height of the first control section is shown by $T_1$ and the differences between the heights of adjacent control sections are shown by $T_2, T_3, \ldots, T_n$, the widths of the respective portions of the flow path having different heights are shown by $W_1, W_2, W_3, \ldots, W_n$, and the lengths of the respective portions of the flow path having the different heights in the flow direction are shown by $L_1, L_2, L_3, \ldots, L_n$. At this time, the respective volumes in the nozzle 74 are formed, respectively to satisfy the following equation.

$$\{S_0\times(OH-T_1)\}<(L_1\times W_1\times T_1)<\ldots<\{L_n\times(W_1\times T_1+\ldots W_n\times T_n)\} \quad \text{Equation 10}$$

where $L=L_1+L_2 \ldots L_2$ and $W_1>W_2$

In the recording head 4, if the opening area of the ejection port 73 is shown by $S_0$, the respective volumes in the nozzle 74 are formed to satisfy the following equation.

$$\{S_0\times(OH-T_1)\}<(L_1\times W_1\times T_1)<\{L_2\times(W_1\times T_1+W_2\times T_2)\} \quad \text{Equation 11}$$

where $L=L_1+L_2$ and $W_1>W_2$

Further, in the recording head 3, the respective sectional areas of the flow path are formed to satisfy the following equation.

$$(W_1\times T_1)<S_0<(W_1\times T_1+W_2\times T_2) \quad \text{Equation 12}$$

where $W_1>L_2$

A method of manufacturing the recording head 4 arranged as described above will now be briefly described. Since the manufacturing method of the recording head 4 is approximately similar to those of the recording heads 1 and 2 described above, the same components are denoted by the same reference numerals, and the description of the same manufacturing steps is omitted.

Figure 18A:
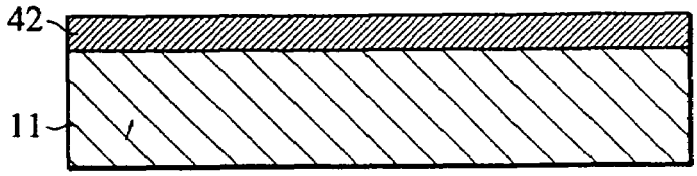
FIGS. 18A to 18D are lateral sectional views explaining a method of manufacturing the recording head.
Figure 18B:
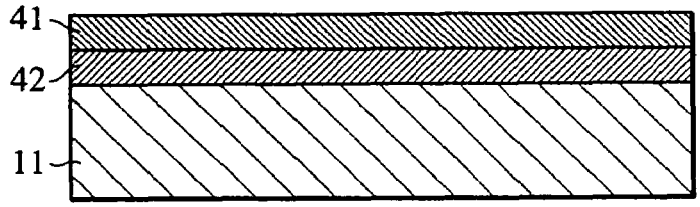
Figure 18C:
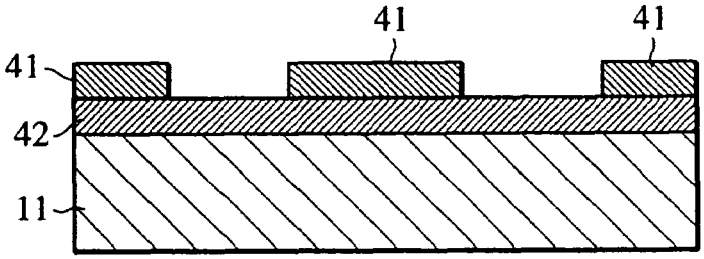
Figure 18D:
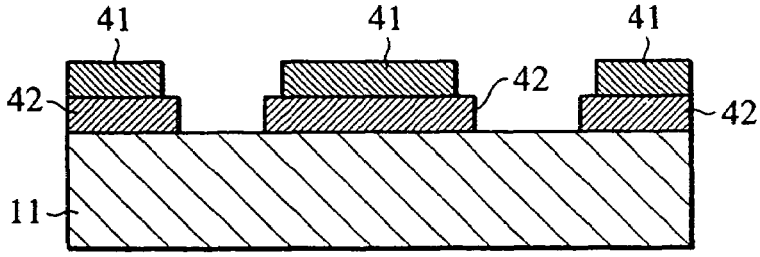

The manufacturing method of the recording head 4 is based on those of the recording heads 1 and 2 described above, and the manufacturing steps of the recording head 4 are the same as those of the recording heads 1 and 2 except for a pattern forming step for forming a nozzle pattern on the upper resin layer 41. In the pattern forming step in the manufacturing method of the recording head 4, the upper and lower resin layers 41 and 42 are formed on the element substrate 11, respectively as shown in FIGS. 18A and 18B, and then the nozzle pattern of the upper resin layer 41 for forming the second control section 79 is formed at a predetermined position on the lower resin layer 42 corresponding to the supply paths 77 as shown in FIGS. 18C and 18D. That is, the manufacturing method of the recording head 4 can easily form the recording head 4 only by partly changing the shape of the nozzle pattern of the upper resin layer 41.

According to the recording head 4 described above, the volumes of the flow paths are reduced as they are apart from the heaters 20 by the provision of the first and second control sections 78 and 79. Thus, a flow path resistance at a position near to a space into which ink flows when the ink is refilled is reduced, whereby a refill time $\underline{t}$ can be further reduced.

Fifth Embodiment

Figure 19:
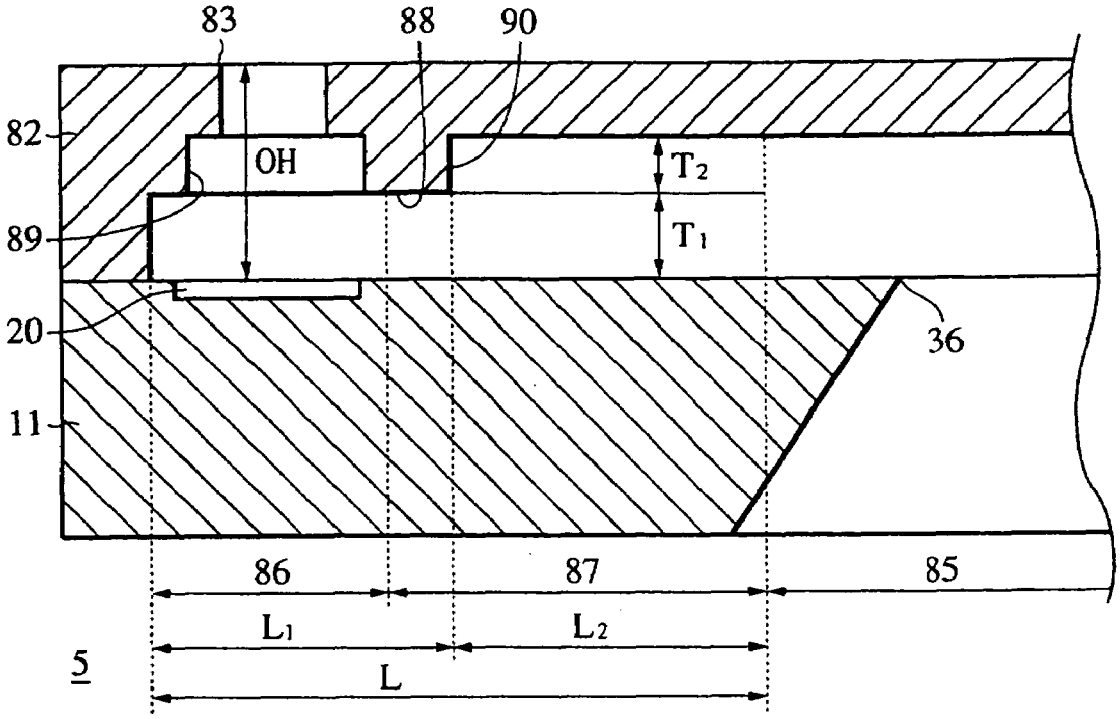
FIG. 19 is a longitudinal sectional view explaining a main portion of a recording head of a fifth embodiment according to the present invention.
Figure 20:
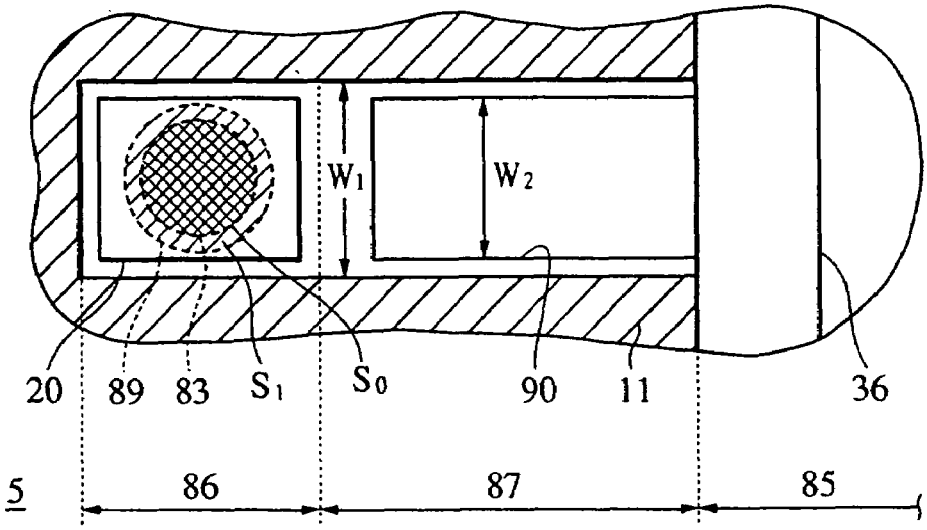
FIG. 20 is a plan view explaining the main portion of the recording head.
Figure 21:
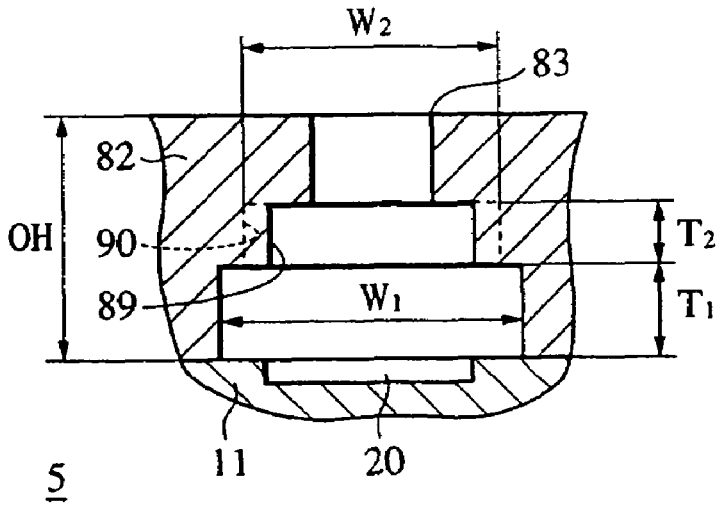
FIG. 21 is a lateral sectional view explaining the main portion of recording head.

As shown in FIGS. 19, 20 and 21, a nozzle forming member 82 provided with a recording head 5 of a fifth embodiment is formed of a resin material to a thickness of about 30 μm. The nozzle forming member 82 includes a plurality of ejection ports 83 for ejecting ink droplets, a plurality of nozzles 84 through which ink flows, and a supply chamber 85 for supplying ink to the respective nozzles 84.

The ejection ports 83 are formed at positions where they confront heaters 20 on an element substrate 11 and are arranged as circular holes each having a diameter of, for example, about 15 μm. Note that the ejection ports 83 may be formed in a radial and approximate star shape when necessary for the convenience of ejection characteristics.

Each nozzle 84 has a bubble forming chamber 86 in which bubbles are formed by a heater 20, a supply path 87 for supplying ink into the bubble forming chamber 86, and first, second, and third control sections 88, 89, and 90 for controlling the ink in the bubble forming chamber 86 flowed by the bubbles.

The bubble forming chamber 86 is formed such that the bottom surface thereof confronting the ejection port 83 has an approximately rectangular shape. The bubble forming chamber 86 is formed such that the shortest distance OH between the main surface of the heater 20, which is parallel to the main surface of the element substrate 11, and the ejection port 83 is set to 30 μm or less.

The supply path 87 is formed such that one end thereof is communicated with the bubble forming chamber 86 and the other end thereof is communicated with the supply chamber 85.

The first control section 88 is formed stepwise along the flow path parallel to the flow direction of ink as well as on a plane perpendicular to the main surface of the element substrate 11 from the bubble forming chamber 86 to the end of the supply path 87 adjacent to the bubble forming chamber 86 in order to change the height of the flow path with respect to the main surface of the element substrate 11. Then, in the nozzle 84, the confronting surface of the first control section 88 that confronts the main surface of the element substrate 11 is formed continuously to the confronting surfaces of the second and third control sections 89 and 90. These confronting surfaces are formed parallel to the main surface of the element substrate 11.

In other words, the first control section 88 causes the height of the nozzle 84 with respect to the main surface of the element substrate 11 to be formed smaller than the height thereof at the other end of the supply path 87 adjacent to the supply chamber 85, in the range from the end of the supply path 87 adjacent to the bubble forming chamber 86 to the bubble forming chamber 86. Accordingly, the nozzle 84 is formed such that the sectional area of the ink flow path is reduced by the first control section 88 from the end of the supply path 87 adjacent to the bubble forming chamber 86 to the bubble forming chamber 86.

The second control section 89 is formed stepwise on the surface of the bubble forming chamber 86 confronting the main surface of the element substrate 11 such that it is continued to the first control section 88 and such that the height of the flow path with respect to the main surface of the element substrate 11, that is, the height of the bubble forming chamber 86, changes parallel to the flow direction of ink as well as on a plane perpendicular to the main surface of the element substrate 11. In other words, the second control section 89 is formed as a circular recess continuous to the ejection port 83.

The third control section 90 is formed stepwise in the range from the one end of the supply path 87 adjacent to the first control section 88 to the other end thereof adjacent to the supply chamber 85 such that the width of the flow path changes on a plane perpendicular to the flow direction of ink along the thickness direction of the nozzle forming member 82. Further, the respective inner surfaces of the nozzles 84 confronting the main surface of the element substrate 11 are formed parallel to the main surface of the element substrate 11, respectively, from the supply chamber 85 to the bubble forming chamber 86.

The recording head 5 arranged as described above is formed to satisfy Equations 10, 11, and 12, respectively, similarly to the recording head 4.

In the recording head 5, if the opening area of the second control section 89 parallel to the main surface of the element substrate 11 is shown by $S_1$, the respective volumes in the nozzle 84 are formed to satisfy the following equation.

$$\{S_0\times(OH-T_1)\}<(S_1\times T_2)<(L_1\times W_1\times T_1)<\{L_2\times(W_1\times T_1+W_2\times T_2)\} \quad \text{Equation 13}$$

where $L=L_1+L_2$ and $W_1>W_2$

According to the recording head 5 described above, since the nozzles 84 are formed to satisfy the respective equations described above, an ejection speed is increased and an ejection amount of the ink droplets is stabilized, whereby an ejection efficiency can be improved and a refill operation can be executed at a high speed.

Sixth Embodiment

In the recording heads 1 to 5 described above, the respective nozzles of the first and second nozzle trains 16 and 17 are formed identically. Finally, in a recording head 6 according to a sixth embodiment, the shape of the nozzles and the area of the heaters of the first nozzle train are different from those of the second nozzle train, as will be described with reference to the drawings.

Figure 22:
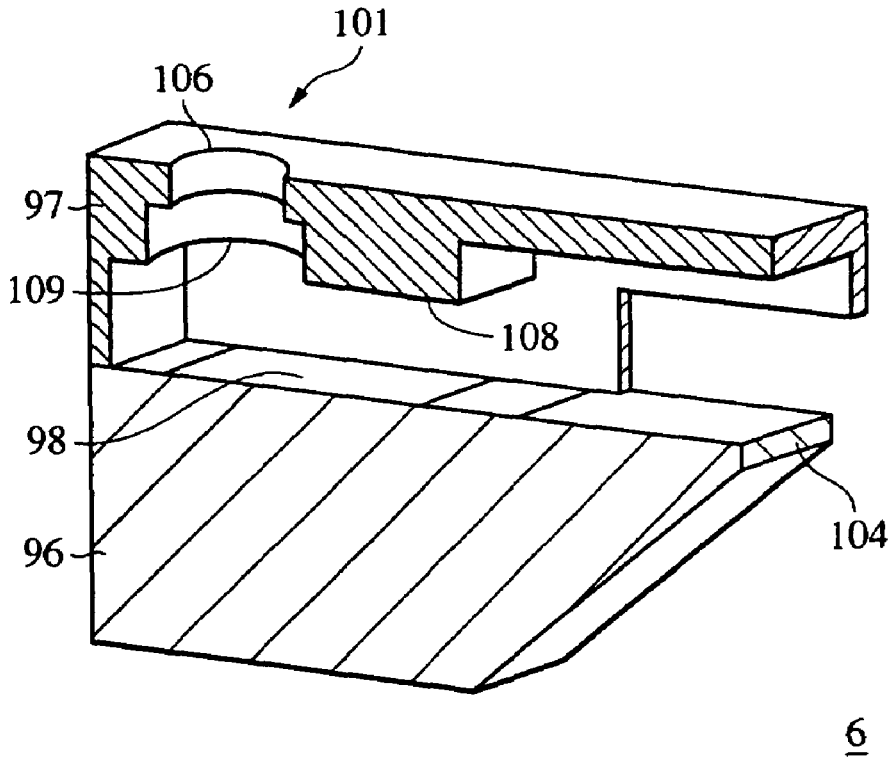
FIG. 22 is a perspective view explaining a first nozzle train of a recording head of a sixth embodiment according to the present invention.
Figure 23:
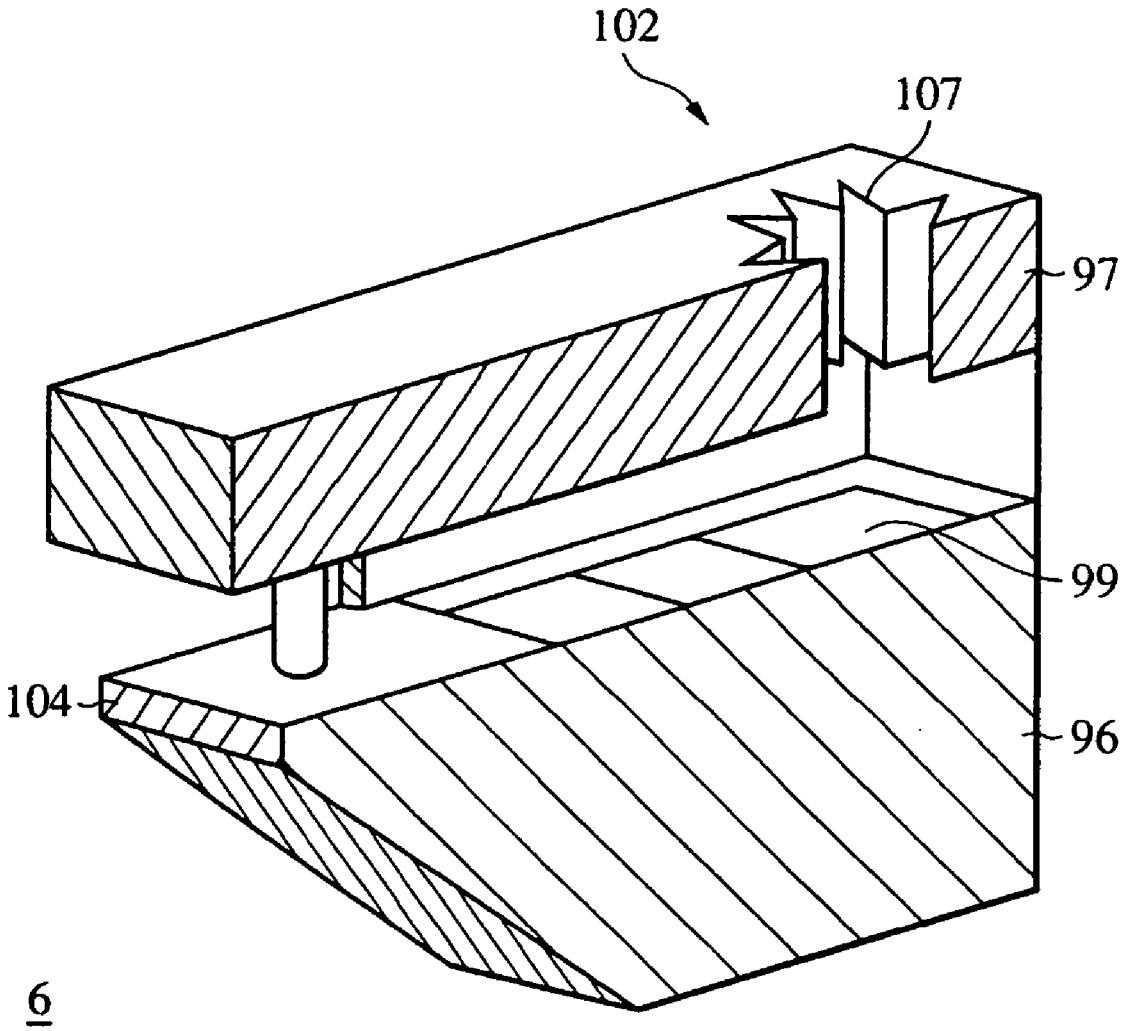
FIG. 23 is a perspective view explaining a second nozzle train of the recording head.

As shown in FIGS. 22 and 23, an element substrate 96 provided in the recording head 6 includes first and second heaters 98 and 99 disposed thereon, respectively, and having different areas parallel to the main surface of the element substrate 96.

Further, nozzle forming members 97 provided in the recording head 6 are formed such that the opening areas of respective ejection ports 106 and 107 and the shapes of the respective nozzles of the first and second nozzle trains 101 and 102 are different from each other. The respective ejection ports 106 of the first nozzle train 101 are formed as circular holes. Since the respective nozzles of the first nozzle train 101 are arranged similarly to those of the recording head 2 described above, the description thereof is omitted. However, each nozzle has first and second control sections 108 and 109 for controlling the flow of ink in a bubble forming chamber.

Further, the respective ejection ports 107 of the second nozzle train 102 are formed in a radial and approximately star shape. Each nozzle of the second nozzle train 102 is formed in a straight shape in which the sectional area of an ink flow path does not change from a bubble forming chamber to a supply chamber.

Further, a supply port 104 is formed on the element substrate 96 to supply ink to the first and second nozzle trains 101 and 102.

Incidentally, the flow of ink in a nozzle is generated by the volume Vd of an ink droplet flown from an ejection port, and an action for recovering a meniscus after an ink droplet has been flown is executed by a capillary force generated according to the opening area of the ejection port. If the opening area of the ejection port is shown by $S_0$, the outer periphery of the opening edge of the ejection port is shown by $L_1$, the surface tension of ink is shown by $\gamma$, and the contact angle between ink and the inner surface of the nozzle is shown by $\theta$, the capillary force p is expressed by the following equation.

$$p=\gamma\cos\theta\times L_1/S_0$$

Further, if it is assumed that a meniscus is generated only by the volume Vd of a flown ink droplet and recovered after an ejection frequency time t (refill time t) passes, the following relationship is established.

$$p=B\times(Vd/t)$$

According to the recording head 6, the first and second nozzle trains 101 and 102 can fly ink droplets having different ejection volumes from the single recording head 6 because in the first and second trains 101 and 102, the areas of the heaters 98 and 99 and the opening areas of the ejection ports 106 and 107 are different from each other.

Further, in the recording head 6, it is possible to set the ejection frequency responsiveness of the first nozzle train 101 substantially the same as that of the second nozzle train 102 by setting the physical values, that is, the inertance A and the viscous resistance B, according to the ejection volumes of the ink droplets ejected from the respective ejection ports 106 and 107. This is because the values representing the physical properties of the ink ejected from the first nozzle train 101, that is, the surface tension, viscosity, and pH thereof, are the same as those of the ink ejected from the second nozzle train 102.

That is, if it is assumed that the respective amounts (volumes) of ink droplets ejected from the first and second nozzle trains 101 and 102 are, for example, 4.0 (p1) and 1.0 (p1) in the recording head 6, then making the refill time t of the first nozzle train 101 approximately the same as that of the second nozzle train 102 is equivalent to making $L_1/S_0$ (i.e., the ratio of the outer periphery $L_1$ of the opening edge to the opening area $S_0$) of the first nozzle train 101 approximately similar to that of the second nozzle train 102 as well as making the viscous resistance B of the first nozzle train 101 approximately similar to that of the second nozzle train 102.

A method of manufacturing the recording head 6 arranged as described above will now be briefly described with reference to the drawings.

Figure 24A:
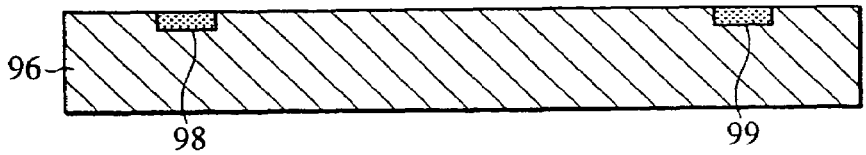
FIGS. 24A to 24E are sectional views explaining manufacturing steps of the recording head.
Figure 24B:
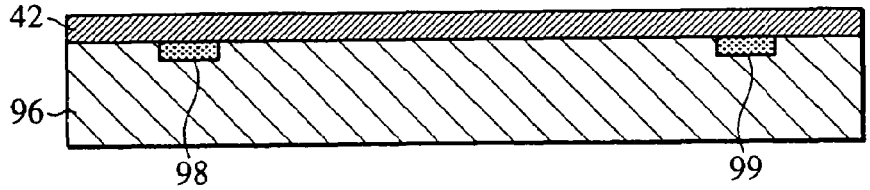
Figure 24C:
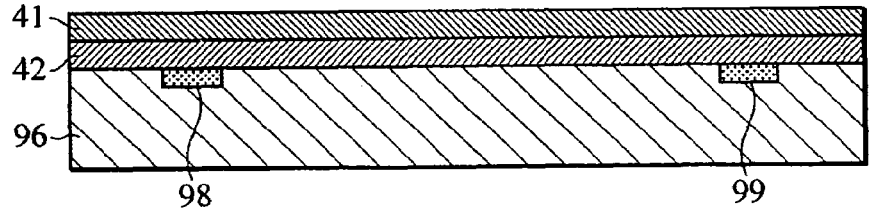
Figure 24D:
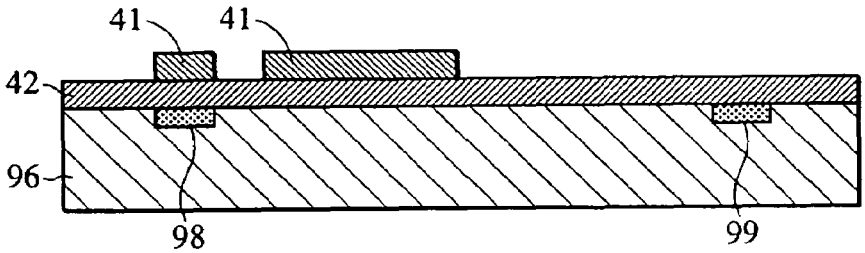
Figure 24E:
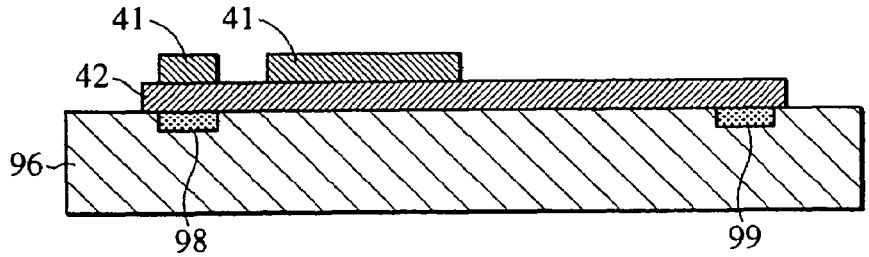
Figure 25A:
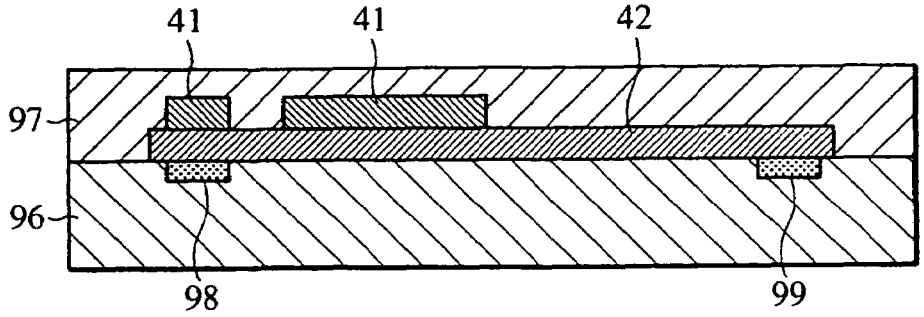
FIGS. 25A to 25D are sectional views explaining manufacturing steps of the recording head.
Figure 25B:
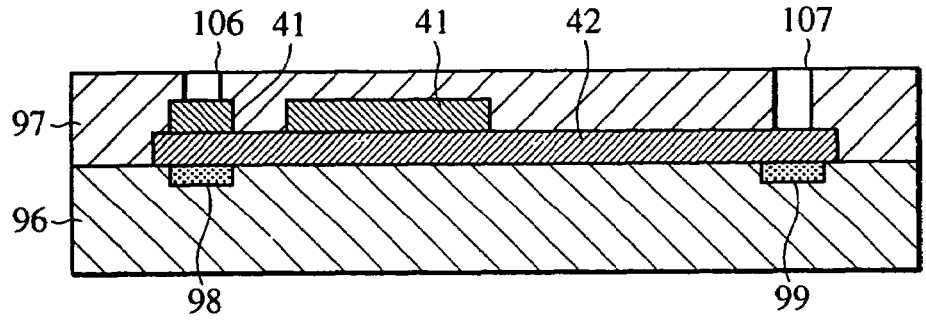
Figure 25C:
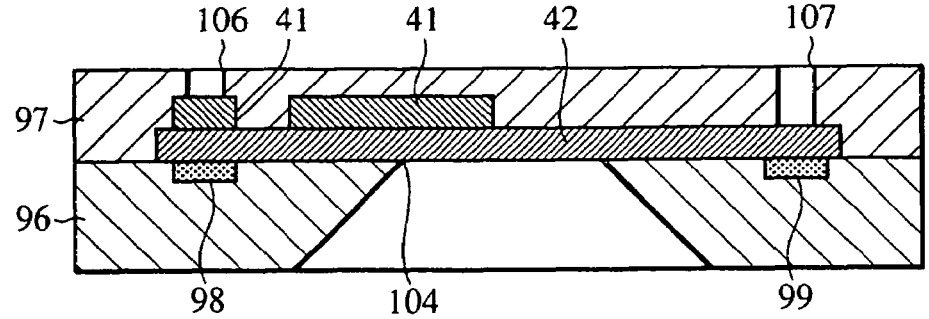
Figure 25D:
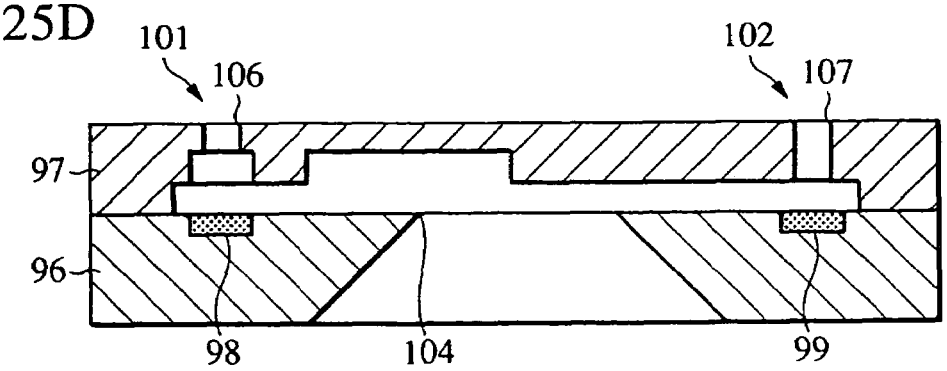

The manufacturing method of the recording head 6 is based on those of the recording heads 1 and 2 described above, and the manufacturing steps of the recording head 6 are the same as those of the recording heads 1 and 2 except for a pattern forming step for forming nozzle patterns in upper and lower resin layers 41 and 42. The manufacturing method of the recording head 6 is such that, in the pattern forming step, the upper and lower resin layers 41 and 42 are formed on the element substrate 96, as shown in FIGS. 24A, 24B, and 24C, and then a desired nozzle pattern is formed for each of the first and second nozzle trains 101 and 102, as shown in FIGS. 24D and 24E. That is, the respective nozzle patterns of the first and second nozzle trains 101 and 102 are formed asymmetrically to the supply port 104. That is, the manufacturing method of the recording head 6 can easily form the recording head 6 only by partly changing the shapes of the nozzle patterns of the upper and lower resin layers 41 and 42. Thereafter, the recording head is formed through a step similar to that shown in FIG. 10 (refer to FIG. 25).

According to the recording head 6 described above, each of the first and second nozzle trains 101 and 102 can eject an ink droplet having a different ejection volume by differently forming the structure of the respective nozzles of each of the first and second nozzle trains 101 and 102, whereby ink droplets can be easily and stably flown with an optimum ejection frequency at a high speed.

Further, according to the recording head 6, when a recovery action is executed by a recovery mechanism, ink can be uniformly and promptly absorbed by adjusting the balance of flow resistance caused by a capillary force, and the recovery mechanism can be arranged simply. Accordingly, the reliability of the ejection characteristics of the recording head 6 can be improved, whereby it is possible to provide a recording apparatus having a more reliable recording operation.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid ejection head comprising:

an energy generation element for generating energy for ejecting liquid droplets;

a chamber having said energy generation element;

a supply path communicating with said chamber for supplying a liquid to said chamber;

an ejection port facing a surface on which said energy generation element is disposed; and an ejection portion having said ejection port, wherein said ejection portion comprises a first portion communicating with said ejection port and a second portion communicating with said first portion and said chamber, wherein said first portion, said second portion and said chamber are respectively connected in a stair-like pattern, and wherein $A_c > A_{e2} A_{e1}$, where $A_c$=a cross-sectional area of said chamber, the cross-sectional area being parallel to the surface on which said energy generation element is disposed, $A_{e2}$=a cross-sectional area of said second portion, the cross-sectional area being parallel to the surface on which said energy generation element is disposed, and $A_{e1}$=a cross-sectional area of said first portion, the cross-sectional area being parallel to the surface on which said energy generation element is disposed.

2. A liquid ejection head according to claim 1, wherein, an opening area of said ejection port is smaller than an area of said energy generation element.

3. A liquid ejection head according to claim 1, wherein a distance from said energy generation element to said ejection port is less than or equal to 30 μm.

4. A liquid ejection head according to claim 1, wherein bubbles generated by said energy generation element communicate with outside air through said ejection port.

5. A liquid ejection head according to claim 1, further comprising a first control portion for controlling at least a flow of the liquid, wherein said second portion and said first control portion are formed at least in part by a common structure.

6. A liquid ejection head according to claim 5, wherein said first control portion acts as a source of fluid resistance to reduce a flow of the liquid away from said bubble forming chamber toward a supply chamber through said supply path.

7. A liquid ejection head according to claim 6, wherein said first control portion serves to reduce a height, with respect to the surface on which said energy generation element is disposed, of a portion of said supply path in a vicinity of said bubble forming chamber.

8. A liquid ejection head according to claim 5, wherein said second portion serves as a second control portion for maintaining pressure created by bubbles generated by said energy generation element, by reducing the extent to which the bubbles are abutted against inner walls of said bubble forming chamber.

9. A liquid ejection head according to claim 1, wherein an opening of said ejection port is circular.

10. A liquid ejection head according to claim 1, wherein a bottom surface of said bubble forming chamber is approximately rectangular.

11. A liquid ejection head according to claim 1, wherein an energy allocation ratio of said ejection port is between 0.5 and 0.8.

12. A liquid ejection head according to claim 11, wherein the energy allocation ratio of said ejection port is equal or approximately equal to 0.68.

* * * * *

UNITED STATES PATENT AND TRADEMARK OFFICE

CERTIFICATE OF CORRECTION

PATENT NO. : 7,384,130 B2
APPLICATION NO. : 11/347604
DATED : June 10, 2008
INVENTOR(S) : Kubota et al.

It is certified that error appears in the above-identified patent and that said Letters Patent is hereby corrected as shown below:

COLUMN 1:
Line 4, "Jul. 10, 2002" should read --Jul. 10, 2002,--.
Line 5, "7,036,909, now allowed." should read --7,036,909.--.

COLUMN 2:
Line 3, "to" (first occurrence) should be deleted.

COLUMN 6:
Line 22, "flow = $\Delta V/\Delta t$)." should read --flow=$\Delta V/\Delta t$):--.
Line 26, "inertance" should read --inertance.--.

COLUMN 7:
Line 5, "fluid." should read --fluid:--.
Equation 6, "$\{\Delta P/\Delta x)\times S(x)\}$" should read --$\{(\Delta P/\Delta x)\times S(x)\}$--.
Line 17, "flowing" should read --following--.

COLUMN 16:
Line 58, "24 pm." should read --24 μm.--.

COLUMN 18:
Line 55, "ejection port" (second occurrence) should be deleted.
Line 67, "height $T_2$" should read --height $T_1$--.

COLUMN 19:
Line 4, "inequality." should read --inequality:--.
Line 6, "$\{S_o\times(OH-T_1)\}<(L_1\times W_1\times T_1)<\{L_2\times(W_1\times T_1+W_2T_2\}$" should read --$\{S_o\times(OH-T_1)\}<(L_1\times W_1\times T_1)<\{L_2\times(W_1\times T_1+W_2T_2)\}$--
Line 7, "$W_1>W_2$" should read --$W_1>W_2$.--.
Line 19, "equation." should read --equation:--.
Line 24, "$W_1>W_2$" should read --$W_1>W_2$.--.
Line 27, "equation." should read --equation:--.
Line 31, "$W_1>W_2$" should read --$W_1>W_2$.--.
Line 32, "head 3," should read --head 4,--.
Line 34, "equation." should read --equation:--.
Line 37, "$W_1>W_2$" should read --$W_1>W_2$.--.

UNITED STATES PATENT AND TRADEMARK OFFICE

CERTIFICATE OF CORRECTION

PATENT NO. : 7,384,130 B2
APPLICATION NO. : 11/347604
DATED : June 10, 2008
INVENTOR(S) : Kubota et al.

It is certified that error appears in the above-identified patent and that said Letters Patent is hereby corrected as shown below:

COLUMN 21:
Line 21, "equation." should read --equation:--.
Line 25, "$W_1>W_2$" should read --$W_1>W_2$.--.

COLUMN 22:
Line 16, "time t" should read --time ±--, and "time t)" should read --time ±--.
Line 39, "4.0 (p1)" should read --4.0 (pl)--.
Line 40, "(p1)" should read --(pl)--.

COLUMN 24:
Line 9, "wherein," should read --wherein--.

Signed and Sealed this

Twenty-fourth Day of March, 2009

John Doll

JOHN DOLL
*Acting Director of the United States Patent and Trademark Office*